US010366872B2

(12) United States Patent
Jarrold et al.

(10) Patent No.: US 10,366,872 B2
(45) Date of Patent: Jul. 30, 2019

(54) FREQUENCY AND AMPLITUDE SCANNED QUADRUPOLE MASS FILTER AND METHODS

(71) Applicant: The Trustees of Indiana University, Bloomington, IN (US)

(72) Inventors: Martin F. Jarrold, Bloomington, IN (US); Deven L. Shinholt, Pflugerville, TX (US); Staci N. Anthony, Bloomington, IN (US); Andrew W. Alexander, Bloomington, IN (US)

(73) Assignee: The Trustees of Indiana University, Indianapolis, IN (US)

( * ) Notice: Subject to any disclaimer, the term of this patent is extended or adjusted under 35 U.S.C. 154(b) by 0 days.

(21) Appl. No.: 16/264,023

(22) Filed: Jan. 31, 2019

(65) Prior Publication Data

US 2019/0164739 A1 May 30, 2019

Related U.S. Application Data

(63) Continuation of application No. 15/524,354, filed as application No. PCT/US2015/059463 on Nov. 6, 2015, now Pat. No. 10,211,040.

(60) Provisional application No. 62/077,001, filed on Nov. 7, 2014.

(51) Int. Cl.
*H01J 49/42* (2006.01)
*H01J 49/00* (2006.01)

(52) U.S. Cl.
CPC ..... *H01J 49/4215* (2013.01); *H01J 49/0031* (2013.01); *H01J 49/427* (2013.01)

(58) Field of Classification Search
USPC ..... 250/292, 281, 282
See application file for complete search history.

(56) References Cited

U.S. PATENT DOCUMENTS

| | | | | |
|---|---|---|---|---|
| 5,285,063 | A | 2/1994 | Schwartz et al. | |
| 5,572,025 | A | 11/1996 | Cotter et al. | |
| 6,753,523 | B1 | 6/2004 | Whitehouse et al. | |
| 8,395,112 | B1 * | 3/2013 | Bier | G01N 21/53 250/281 |
| 2003/0155502 | A1 | 8/2003 | Grosshans et al. | |
| 2010/0084552 | A1 | 4/2010 | Kawana | |

(Continued)

OTHER PUBLICATIONS

Anthony, et al., A simple electrospray interface based on a DC ion carpet, Int. J. Mass Spectrom. 371, 1-7 (2014).

(Continued)

*Primary Examiner* — Kiet T Nguyen
(74) *Attorney, Agent, or Firm* — Barnes & Thornburg LLP

(57) ABSTRACT

A quadrupole mass filter and method for operating the filter are described. Sample ions, each having a mass-to-charge ratio, are passed to a quadrupole at least one AC voltage is applied thereto to separate the ions by incrementally varying a frequency of the at least one AC voltage within a first range of frequencies and, for each of at least some of the incremental frequencies in the first range of frequencies, incrementally varying an amplitude of the at least one AC voltage within a range of amplitudes, wherein each incremental frequency and incremental amplitude pair of the at least one AC voltage creates a different band pass filter in the quadrupole through which produced ions having a different corresponding mass-to-charge ratio pass to a detector.

20 Claims, 16 Drawing Sheets

(56) References Cited

U.S. PATENT DOCUMENTS

| | | | | |
|---|---|---|---|---|
| 2010/0320377 | A1 | 12/2010 | Cotter et al. | |
| 2012/0112056 | A1 | 5/2012 | Brucker et al. | |
| 2013/0200261 | A1 | 8/2013 | Mizutani et al. | |
| 2016/0181084 | A1* | 6/2016 | Smith | H01J 49/4215 250/282 |

OTHER PUBLICATIONS

Beuhler, et al., Threshold studies of secondary electron emission induced by macro ion impact on solid surfaces. Nucl. Instrum. Methods. 170, 309-315 (1980).
Beuhler, et al., A study of the formation of high molecular weight water cluster ions {m/e < 59000) in expansion of ionized gas mixtures, J. Chem. Phys. 77, 2549-2557 (1982).
Brancia, et al., Digital asymmetric waveform isolation {DAWI) in a digital linear ion trap. J. Am. Soc. Mass Spectrom. 21, 1530-1533 (2010).
Chernushevich, et al., Collisional cooling of large ions in electrospray mass spectrometry. Anal. Chem 76. 1754-1760 (2004).
Xiong, et al., The development of charge detection-quadrupole ion trap mass spectrometry driven by rectangular and triangular waves, Analyst 137, 1199-1204 (2012).
Ding, et al., A simulation study of the digital ion trap mass spectrometer. Int. J. Mass Spectrom. 221, 117-138 (2002).
Ding, et al, A digital ion trap mass spectrometer coupled with atmospheric pressure ion sources. J. Mass Spectrom. 39, 471-484 (2004).
Douglas J. Linear quadrupoles in mass spectrometry. Mass Spectrom. Rev. 28, 937-960 (2009).
Kim et al., A multicapillary inlet jet disruption electrodynamic ion funnel interface for improved sensitivity using atmospheric pressure ion sources. Anal. Chem. 73, 4162-4170 (2001).
Koizumi et al., A novel phase-coherent programmable clock for high-precision arbitrary waveform generation applied to digital ion trap mass spectrometry. Int. J. Mass Spectrom. 292, 23-31 (2010).
Konenkov et al., Matrix methods for the calculation of stability diagrams in quadrupole mass spectrometry. J. Amer. Soc. Mass Spec. 13, 597-613 (2002).
Landais et al., Varying the radio frequency: A new scanning mode for quadrupole analyzers. Rapid Commun. Mass Spectrom. 12, 302-306 (1998).
Marmet et al., A frequency-swept quadrupole mass filler. Int. J. Mass Spectrom. Ion Proc. 42, 3-10 (1982).
Martin, Stability of doubly charged alkali halide clusters. J. Chem. Phys. 76, 5467-5469 (1982).
Nie et al., Frequency scan of a quadrupole mass analyzer in the third stability region for protein analysis. J. Chin. Chem. Soc., 53, 47-52 (2006).
Paul et al., Das elektrische massenfilter als massenspektromeler und isotopenlrenner. Z. Phys. 152, 143-182 (1958).
Richards et al., A new operating mode for the quadrupole mass filler. Int. J. Mass Spectrom. Ion Phys. 12, 317-339 (1973).
Richards et al., Waveform parameter tolerances for the quadrupole mass filler with rectangular excitation. Int. J. Mass Spectrom. Ion Phys. 15, 417-428 (1974).
Schlunegger et al., Frequency scan for the analysis of high mass ions generated by matrix-assisted laser desorption/ionization in a Paul trap. Rapid Commun. Mass Spectrom. 13, 1792-1796 (1999).
Shinhol T, Review of Scientific Instruments. 85, 113109 (2014); doi: 10.1063/1.4900627.
Sobott et al., A tandem mass spectrometer for improved transmission and analysis of large macromolecular assemblies. Anal. Chem. 74, 1402-1407 (2002).
Syed, et al., Quadrupole mass filler: Design and performance for operation in stability zone 3. J. Am. Soc. Mass Spectrom. 24, 1493-1500 (2013).
Yang, et al., Development of a palm portable mass spectrometer. J. Amer. Soc. Mass Spec. 19, 1442-1448 (2008).
Yost, et al., Selected ion fragmentation with a tandem quadrupole mass spectrometer. J. Am. Chem. Soc. 100, 2274-2275 (1978).
Paul, et al., Das elektrische massenfiller, Z. Phys. 140, 262-273 (1955).
Winger, et al., Observation and implications of high mass-lo-charge ratio ions from electrospray ionization mass spectrometry, J. Am. Soc. Mass Spectrom. 4, 536-545 (1993).
PCT International Search Report and Written Opinion completed by the ISA/US dated Jan. 12, 2016 and issued in connection with corresponding PCT/US2015/059463.

* cited by examiner

FREQUENCY AND AMPLITUDE SCANNED QUADRUPOLE MASS FILTER AND METHODS

CROSS REFERENCE TO RELATED APPLICATIONS

This is a continuation of U.S. patent application Ser. No. 15,524,354, filed May 4, 2017, which is a national stage entry of International Patent Application No. PCT/US2015/059463, filed Nov. 6, 2015, which claims the benefit of and priority to U.S. Provisional Patent Application Ser. No. 62/077,001, filed Nov. 7, 2014, the disclosures of which are all expressly incorporated herein by reference in their entireties.

STATEMENT REGARDING FEDERALLY SPONSORED RESEARCH OR DEVELOPMENT

This invention was made with government support under CHE0911462 awarded by the National Science Foundation. The government has certain rights in the invention.

TECHNICAL FIELD

This disclosure relates generally to the generation of mass spectra and more specifically to using quadrupole mass filters to analyze ions.

BACKGROUND

Quadrupole mass filters (QMFs) have become valuable analytical resources for generating mass spectra. QMFs are usually not used to analyze high m/z ions, due to the low frequency resonant circuits that drive them. Efforts to develop QMFs have been focused on increasing the maximum m/z value that the instruments are useful in detecting while maintaining a useful resolving power.

Several factors may limit the maximum m/z value that a QMF may be useful for resolving. Quadrupole mass filters are generally scanned by scanning RF amplitude with a fixed frequency. RF amplitude is proportional to the center of the m/z band transmitted by a QMF. Therefore, increasing RF amplitude increases m/z values that may be used with a QMF. The maximum m/z value that can be transmitted is limited by the maximum RF amplitude that can be achieved before electrical breakdown and/or power consumption become concerns. Also, for amplitude scans, the transmission efficiency for ions with the same energy and charge decreases as the m/z increases.

The center of the m/z band transmitted by a QMF is also proportional to $1/f^2$ where f is frequency. As frequency is decreased, the m/z value that may pass through a QMF increases. However, if frequency is not well-defined, resolving power may suffer. Although the ability to scan frequency over a wide range may also be desirable, known commercial frequency synthesizers are generally unable to provide accuracy over a range desirable to use QMFs to detect large m/z values.

SUMMARY

A method for operating a quadrupole mass filter is described herein. The method includes ionizing a sample to provide ions, each ion having a mass-to-charge ratio, passing the ions toward a quadrupole, and applying a plurality of AC voltages to the quadrupole to separate the ions. Each one of the AC voltages is distinct from the other AC voltages and has one of a series of frequencies. Each frequency in the series of frequencies corresponds to an AC voltage having a nominal amplitude that creates a first band pass filter such that a first set of the ions, having a first one of the mass-to-charge ratios, passes through the quadrupole to a detector and an AC voltages having an adjusted amplitude, greater than the nominal amplitude, that creates a second band pass filter such that a second set of the ions, having a second one of the mass-to-charge ratios different than the first one of the mass-over-charge ratios, passes through the quadrupole to the detector.

In some embodiments, the difference between the first mass-to-charge ratios corresponding to consecutive frequencies may be greater than the difference between the first and second mass-to-charge ratios corresponding to the higher one of the consecutive frequencies.

In some embodiments, the difference between the first mass-to-charge ratios corresponding to consecutive frequencies may be about twice as much as the difference between the first and second mass-to-charge ratios corresponding to the higher one of the consecutive frequencies.

In some embodiments, the AC voltage may have a waveform selected from the group consisting of trapezoidal, sinusoidal, and square.

In some embodiments, the trapezoidal waveform may have a rise time, a fall time, a peak time, and a base time, and the sum of the rise time and the fall time may be about twice as much as the sum of the peak time and the base time.

In some embodiments, the AC voltages may each be applied to the quadrupole for equal time intervals while the sample is being ionized.

In some embodiments, the AC voltages may each be applied to the quadrupole for equal time intervals of about 50 ms while the sample is being ionized.

In some embodiments, the sample may be ionized by electrospray ionization.

In some embodiments, the detector may be a microchannel plate detector or an electron multiplier.

In some embodiments, the mass-to-charge ratio of each ion may be up to about 200,000 Th, about 100,000 Th, about 50,000 Th, or about 10,000 Th.

In some embodiments, the mass-to-charge ratio of each ion may be detected at a resolving power from about 600 to about 1200.

In some embodiments, each frequency in the series of frequencies may be from about 12 MHz to about 500 MHz.

In some embodiments, each frequency (f) in the series of frequencies may be determined according to the equation $$f = \frac{f_{clock}}{2n},$$

where f clock is a constant frequency value, and n is an integer from 1 to about 30.

In some embodiments, f clock may be from about 300 MHz to about 700 MHz.

In some embodiments, each of the nominal and adjusted amplitudes may be from about 10 V to about 1000 V or about 50 V to about 500 V.

In some embodiments, the difference between the nominal and adjusted amplitudes may increase as the frequency in the series of frequencies decreases.

In some embodiments, each of the differences between the nominal and adjusted amplitudes may be less than about 0.2% of the nominal amplitude.

In some embodiments, each of the AC voltages may have a DC offset and the DC offset may be varied inversely to the amplitude of each of the AC voltages.

In some embodiments, the amplitude and the DC offset of each of the AC voltages may be such that the quadrupole is operated near the apex of a stability region.

In some embodiments, the amplitude and the DC offset of each of the AC voltages may be such that the quadrupole is operated in the third stability region.

BRIEF DESCRIPTION OF THE DRAWINGS

The detailed description refers to the accompanying figures, in which.

DETAILED DESCRIPTION

Figure 1:
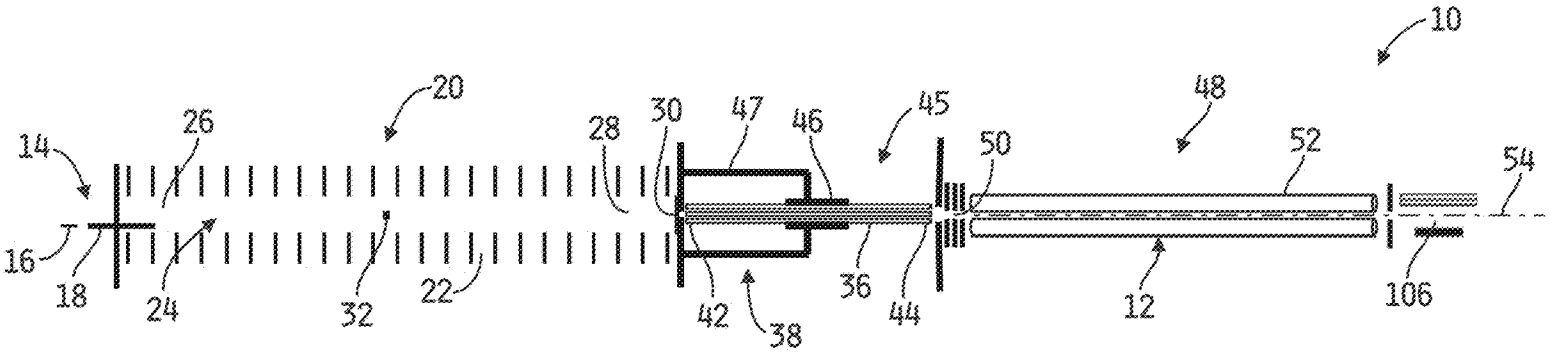
FIG. 1 is a diagrammatic view of a quadrupole mass filter (QMF)

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but, on the contrary, the intention is to cover all modifications, equivalents, and alternatives falling within the spirit and scope of the present disclosure.

References in the specification to "one embodiment," "an embodiment," "an illustrative embodiment," "some embodiments," "a further embodiment," etc. indicate that the embodiment described may include a particular element, feature, structure, or characteristic, but it is contemplated that such elements, features, structures, and characteristics may be used throughout the embodiments described herein, in various combinations. Moreover, in some instances, certain embodiment may not necessarily include the particular feature, structure, or characteristic.

A quadrupole mass filter (QMF) 10 is shown in FIG. 1. The quadrupole mass filter 10 is adapted to ionize a sample and introduce the sample to a quadrupole 12. An alternating current (AC) voltage is applied to the quadrupole 12 by QMF drive circuits 104 (shown in FIG. 3), which creates an electric field in the quadrupole 12. Depending on the properties of the AC voltage (i.e. frequency, amplitude, and direct current (DC) offset), ions having certain mass-to-charge ratios (m/z) pass through the quadrupole 12 while ions having other mass-to-charge ratios collide with the quadrupole 12 and do not pass through. Thus, applying the AC voltage to the quadrupole 12 results in a band pass filter. The ions that pass through the quadrupole 12 are counted by a detector 106 such that a mass spectrum is generated.

Figure 4:
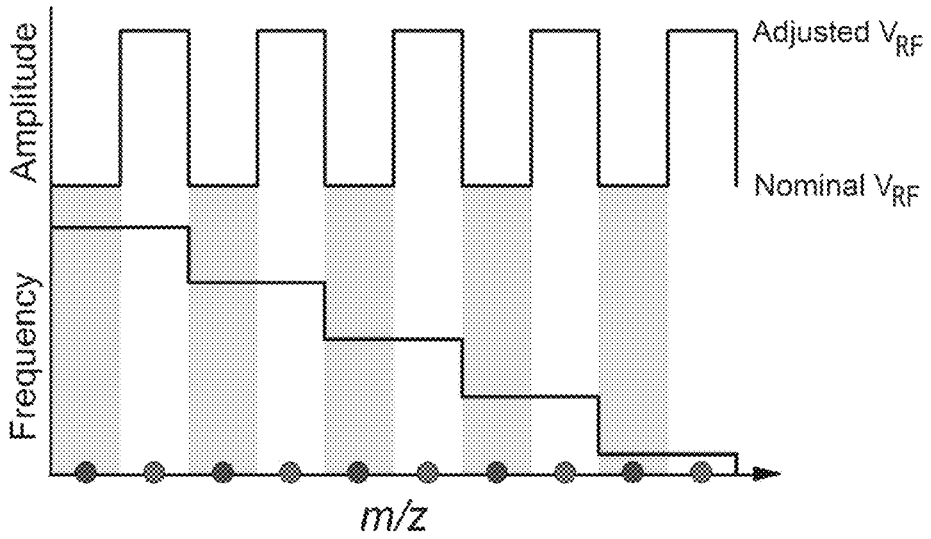
FIG. 4 is a plot showing the sequence of events when m/z is scanned with a synchronized frequency and amplitude scan.

As will be further described below, the frequency and amplitude of the AC voltage applied to the quadrupole are varied in a manner that increases resolution of the mass spectra resulting from the quadrupole mass filter 10. Referring now to FIG. 4, in order to increase the sample resolution of the quadrupole mass filter 10, a frequency scan is performed, along with a synchronized amplitude scan. A series of AC voltages having decreasing frequencies are applied to the quadrupole 12 (shown in FIG. 1). For each frequency, a first AC voltage applied to the quadrupole 12 has a nominal amplitude and a second AC voltage applied to the quadrupole 12 has an adjusted amplitude that is greater than the nominal amplitude. To increase sampling resolution, amplitude is adjusted at each frequency, allowing additional mass-to-charge ratios to pass through the quadrupole 12.

Figure 3:
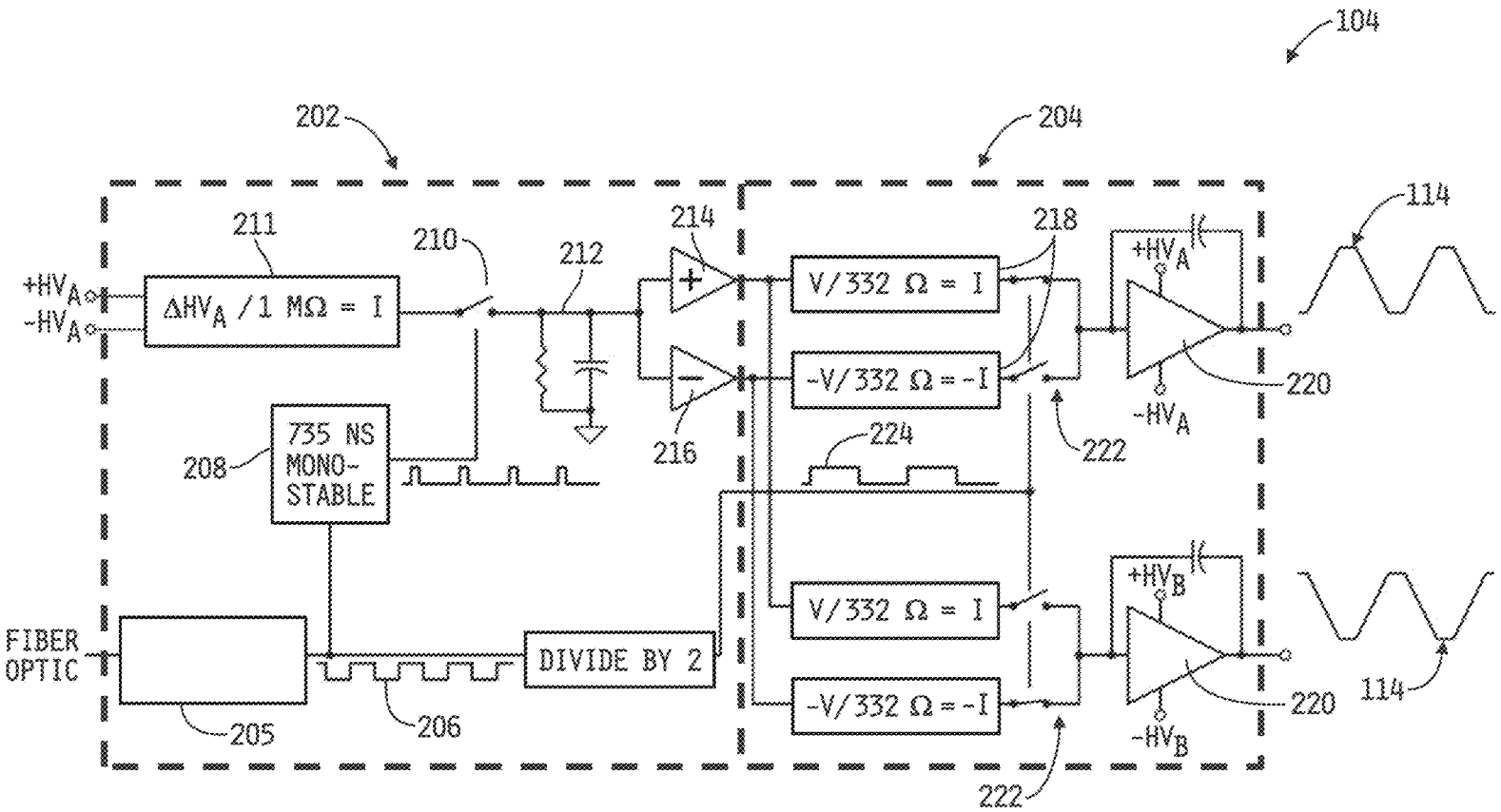
FIG. 3 is a diagrammatic view of the QMF drive circuit of FIG. 2, which is divided into a slew rate control portion and a rail-to-rail integrating amplifiers portion.

In some embodiments, the AC voltage applied to the quadrupole 12 has a trapezoidal waveform, as shown in FIG. 3. Trapezoidal waves 114 approximate sine waves and have smaller harmonic contributions than square waves, thereby avoiding problems with ringing compared with square waves. The trapezoidal waves 114 have a rise time, a fall time, a peak time, and a base time. Harmonics can be minimized by selecting appropriate rise and fall times of the trapezoidal waves, as described further hereinbelow.

Figure 2:
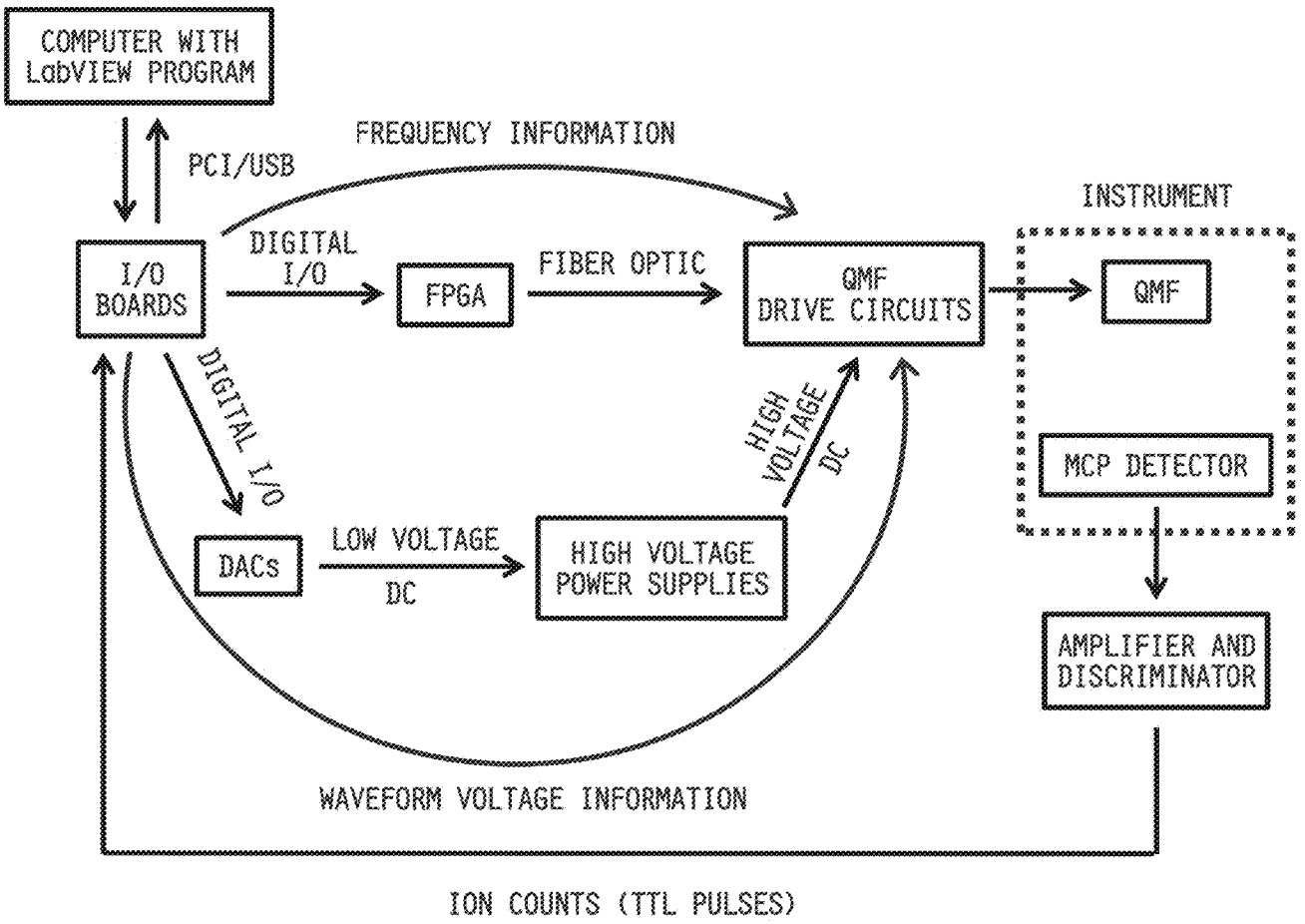
FIG. 2 is a schematic view showing a system configured for information flow from a computer to a QMF drive circuit, which applies an AC voltage to the quadrupole mass filter of FIG. 1, and from an ion detector to the computer.

Referring now to FIG. 2, a computer with a LabVIEW program allows an operator to input a mass spectrometry method and/or general parameters for operating the quadrupole mass filter 10. Frequency and waveform voltage information are sent from the computer to QMF drive circuits 104 (shown in FIG. 3), which apply AC voltages to the QMF according to the mass spectrometry method input by the user. As ions are counted by the detector 106, ion counts are transmitted back to the computer. The computer, in turn, pairs these ion counts to the AC voltage that was applied to the quadrupole 12. As ion counts at various mass-to-charge ratios are detected, a mass spectrum is obtained and recorded by the computer.

Referring again to FIG. 1, a diagrammatic view of a quadrupole mass filter 10 is shown. The apparatus includes an electrospray source 14. The electrospray source 14 is configured to generate ions by electrospray ionization. In one embodiment, the electrospray source 14 includes an electrospray tip 16 pulled from silica capillary tubing (Polymicro, 350 μm OD, 250 μm ID). A syringe pump (Cole-Parmer, Model 74900) is configured to provide a constant flow of a solution to the tip 16. An electrospray voltage is applied to the tip 16 through the solution thereby creating an electrospray. In some embodiments, the electrospray voltage is about 1 kV to about 5 kV, about 1.5 kV to about 2.5 kV, or about 1.75 kV to about 2.0 kV. In a further embodiment the electrospray voltage is 1.8 kV. The electrospray is sampled by a heated stainless steel capillary 18 (0.076 cm ID). The ions, entrained in air, are transported by the stainless steel capillary 18 into a first differentially pumped region 20 of the quadrupole mass filter 10. The pressure in the first differentially pumped region 20 can be raised by admitting additional air through a leak valve. In some embodiments, an operating pressure of the first differentially pumped region 20 is about 700 mTorr.

The first differentially pumped region 20 includes a long drift tube 22. The long drift tube 22 defines a long drift interior 24 having a first end 26 and a second end 28. The long drift interior 24 is connected to the electrospray source 14 such that ions may exit the stainless steel capillary 18 into the first end 26 of the long drift interior 24. In some embodiments, the long drift interior 24 is 31.6 cm long and the long drift tube 22 comprises 74 ring electrodes (2.54 cm ID). In further embodiments, the electrodes are made of brass and are spaced 0.381 cm apart.

The long drift tube 22 is operable to guide the ions towards a DC ion carpet 30 coupled to the second end 28 of the long drift interior 24. Opposite phases of an RF signal (about 300 V peak-to-peak, 140 kHz) are applied in an alternating manner to the ring electrodes such that adjacent electrodes receive waveforms that are 180° out of phase, resulting in RF fields to constrain the ions radially. A DC gradient in the long drift tube 22 (about 1.0 V/cm) directs the ions towards the DC ion carpet 30. A jet disrupter 32 placed midway along the long drift interior 24 blocks large droplets and disrupts directed gas flow from the capillary.

The DC ion carpet 30 separates the first differentially pumped region from a second differentially pumped region 38. The DC ion carpet 30 comprises concentric ring electrodes on a printed circuit board with a central exit aperture (0.10 cm ID). A DC voltage gradient across the concentric ring electrodes (+260 V on the outermost ring electrode with the innermost ring grounded) funnels the ions through the aperture into a hexapole 36. In some embodiments, RF signals are not applied to the DC ion carpet 30. The DC ion carpet and its performance are described in Anthony et al. *Int. J. Mass Spectrom.* 371, 1-7 (2014), which is expressly incorporated herein by reference in its entirety.

The DC ion carpet 30 is connected to a hexapole 36 having a first end 42 and a second end 44. The hexapole 36 is located in the second differentially pumped region 38. In some embodiments, an RF signal (200 V peak-to-peak, 285 kHz) is applied to the hexapole 36. The first end 42 of the hexapole 36 is connected to the DC ion carpet 30 such that after the ions pass through the aperture in the DC ion carpet 30, the ions enter the hexapole 36 and are guided therein. The second end 44 of the hexapole 36 is surrounded by a hexapole sleeve 46. In some embodiments, the hexapole sleeve is a 3.8 cm long conductance-limiting sleeve. The part of the hexapole 36 that is in the second differentially pumped region 38 is enclosed by a thermalization cell 47. The pressure of the second differentially pumped region 38 is adjusted to an elevated pressure that may range from about 30 to about 110 mTorr by adding gas through a leak valve. In some embodiments the elevated pressure is 30 to 110 mTorr. The elevated pressure thermalizes the ions, removing kinetic energy gained by the ions in the DC ion carpet 30 and in expansion upon exiting the aperture. The hexapole sleeve 46 allows the ions to travel into a third differentially pumped region 45 (about $6.7\times10^{-5}$ Torr) through a gradual pressure drop while still in the hexapole 36. The ions then pass into a fourth differentially pumped region 48 (about $1.5\times10^{-6}$ Torr) by passing through an einzel lens 50 that focuses them into the quadrupole 12.

The hexapole 36 is connected to the einzel lens 50 such that the ions pass through the hexapole 36 and are focused toward the quadrupole 12 that is connected to the second end 44 of the hexapole 36. In some embodiments, the quadrupole 12 comprises four cylindrical metal rods 52 arranged symmetrically around a central axis 54. Opposing cylindrical metal rods 52 are connected electrically, and two orthogonal pairs of opposing cylindrical metal rods 52 receive RF signals with opposite phases and DC voltages with the opposite polarities. In some embodiments, the RF signals are two opposite-phase trapezoidal waves that drive the quadrupole mass filter 10.

In some embodiments, the RF signal applied to the hexapole 36 (200 V peak-to-peak, 285 kHz) is floated at a small DC potential (8 V) which defines an ion energy relative to a QMF pole zero (the potential on the central axis of the QMF). In some embodiments, the quadrupole 12 (Extrel Corp.) has 9 mm diameter rods.

Referring now to FIG. 2, a diagrammatic view of a system configured for information flow from a computer to QMF drive circuits 104 and from an ion detector 106 to the computer is shown. A LabVIEW (National Instruments) program controls the QMF drive circuits 104, inputs data from the ion detector 106, and generates an m/z spectrum. The LabView program is further described below in Example 4. FIG. 2 shows how information is transferred from the computer to the QMF drive circuits 104. The LabVIEW program controls two I/O boards (Measurement Computing, PCI-2517 and USB-4301), which in turn communicate digitally with the QMF drive circuits 104 to drive the QMF 10. The program communicates with a field programmable gate array (FPGA) to generate a first frequency. The program also controls power supplies that provide the voltages that determine an RF amplitude, the DC voltages, and the pole zero voltage applied to the quadrupole 12. In some embodiments, the power supplies are four low-noise DC power supplies (Matsusada Precision, Inc., RG-360-0.2) that are controlled through true 18-bit digital-to-analog converters (DAC) (Linear Technology, LTC2756).

A first frequency is digitally generated by dividing a high-frequency stabilized base clock in a counter. This method allows the first frequency to be defined with an accuracy that is better than that of the clock because of averaging inherent in the counting process. A high clock frequency is desirable because it gives a wider range of possible first frequencies by division. The FPGA (Xilinx, Artix-7) was programmed to convert a stable (<1 ps RMS phase jitter, ±50 ppm frequency stability) 200 MHz clock (SiTime Corp., SiT9102) to 570 MHz via a phase lock loop. The 570 MHz frequency was divided in the FPGA by a 24 bit number provided by the LabVIEW program via the I/O boards. In this configuration, the FPGA acts as a high-speed digital counter. The first frequency is sent to the QMF drive circuits 104 via an optical fiber. The first frequency sent to the QMF drive circuits 104 is twice the RF frequency of resulting trapezoidal waves 114, described hereinbelow.

The trapezoidal waves 114 approximate sine waves and have smaller harmonic contributions than square waves, thereby avoiding problems with ringing compared with square waves. The trapezoidal waves 114 have a rise time, a fall time, a peak time, and a base time. The rise time is the time spent as voltage increases, for example from a minimum voltage to a maximum voltage. The fall time is the time spent as voltage decreases, for example from the maximum voltage to the minimum voltage. The peak time is the time spent at the maximum voltage. The base time is the time spent at the minimum voltage. For trapezoidal waves 114, harmonics can be minimized by selecting appropriate rise and fall times. For the trapezoidal waves 114, the harmonic contributions are minimized when a time period spent transitioning from peak-to-peak (the sum of the rise time and the fall time) is twice the time period spent at the minimum and maximum voltages (the sum of the peak time and the base time). When this occurs, the third harmonic vanishes and the contribution from all higher order harmonics is less than 10% of the fundamental.

It is to be understood that the embodiments described herein may use trapezoidal waves, square waves, sinusoidal waves, and the like. Many non-sinusoidal waves may be used with the QMF 10. Digitally generated, arbitrary waveforms provide flexibility in selected ion ejection. In some embodiments, a frequency-scanned QMF 10 is driven by rectangular and triangular waves. In further embodiments, digitally generated arbitrary square waves to drive the QMF 10. In some embodiments, direct digital synthesis (DDS) on the field programmable gate array (FPGA) is used to generate square waves with a variable duty cycle.

Ions that pass through the QMF are detected with a detector 106 that is a collision dynode (−7 kV) and a pair of microchannel plates (MCPs) (Photonis Inc.) in a chevron configuration, as shown in FIG. 1. The signal from the MCPs 58 is amplified in a fast pulse preamplifier and further processed by an amplifier and discriminator, as shown in FIG. 2. TTL pulses from the discriminator are counted in one of the 20 MHz counters on the USB-4301 I/O board.

Referring now to FIG. 3, a diagrammatic view of the QMF drive circuits 104 is shown. The QMF drive circuits 104 provide the RF frequency, the RF amplitude, and the DC voltage to the quadrupole 12. The QMF drive circuits 104 combine information about the RF frequency, the RF amplitude, the DC voltage, and the pole zero voltage to generate the two trapezoidal waves 114 defining an RF signal that drives the quadrupole mass filter 10.

The QMF drive circuits 104 are divided into a slew rate control portion 202 and a rail-to-rail integrating amplifiers portion 204. The slew rate control portion 202 transmits a voltage that is proportional to the slope of the trapezoidal waveform 114 produced by the QMF drive circuits 104. The integrating amplifiers portion 204 uses the voltage from the slew rate control portion 202 to generate the trapezoidal waveform 114. In some embodiments, the QMF drive circuits 104 are mounted inside a stainless steel box within a vacuum chamber. The stainless steel box is located directly underneath the QMF 10 to minimize noise and load capacitance.

In the slew rate control portion 202, a fiber optic receiver 205 converts the signal from the FPGA into a TTL signal 206. The TTL signal 206 triggers a monostable multivibrator 208, which allows a brief current pulse to flow through a gated transistor 210. A DC voltage having a first high voltage ($+HV_a$) and a first low voltage ($-HV_a$) passes across a resistor 211 to provide the brief current pulse. The amplitude of the current pulse is proportional to the RF amplitude of the trapezoidal waves 114 to be generated. The current pulses pass through a filter 212 and are converted to inverted and non-inverted DC voltages by a positive buffer 214 and a negative buffer 216. The inverted and non-inverted DC voltages define the slopes of the trapezoidal wave 114. In some embodiments, the magnitude of the inverted and non-inverted DC voltages is varied depending on both the desired frequency and amplitude of the waveform to be generated. In addition, the TTL signal 206 from the FPGA is divided by two and a divided frequency signal is sent to the integrating amplifiers portion 204.

The inverted and non-inverted DC voltages pass across resistors 218. In some embodiments, the resistors 218 provide a resistance of 332*g*. The resistors 218 are integrated by rail-to-rail integrating amplifiers 220. Two power supply rails of each amplifier 220 represent the high and low voltages for a phase corresponding to one of the amplifiers 220. One pair of the power supplies rails has the first high voltage ($+HV_a$) and the first low voltage ($-HV_a$). The other pair of the power supplies rails has a second high voltage ($+HV_b$) and a second low voltage ($-HV_b$). The difference between the first high voltage ($+HV_a$) and the first low voltage ($-HV_a$) is the same as the difference between the second high voltage ($+HV_b$) and the second low voltage ($-HV_b$). The difference between the first high voltage ($+HV_a$) and the second high voltage ($+HV_b$) corresponds to the DC voltage of the trapezoidal waveform 114. The voltages can be calculated in a program such as LabVIEW from the RF amplitude, the DC voltage, and the pole zero voltage of the desired RF signal, and set using the 18 bit DACs that control the DC power supplies. Two pairs of gates 222 are driven by the divide TTL signal 224 and connected with amplifiers 220 such that when one amplifier 220 receives the inverted DC voltage the other amplifier 220 receives the non-inverted DC voltage.

In some embodiments, in one cycle of generating the waveform, the RF signal of one of the inverted and non-inverted DC voltages starts at a negative rail. The divided frequency signal switches the polarity of the current source being received by the integrating amplifiers 220, so that an output voltage of the RF signal starts to increase linearly. The output voltage of the RF signal reaches the positive rail in a third of the time of the cycle. Then, voltage is constant for a sixth the time of the cycle after which the divided frequency changes state and switches the polarity of the current source. The output voltage starts to decrease linearly reaching the negative rail in a third of the time of the cycle. Then, voltage is constant for a sixth of the time of the cycle whereupon the process repeats.

In some embodiments, the RF frequency, the RF amplitude, and the DC voltage applied to the QMF are varied in a stepwise manner, thereby forming various combinations. Each combination of the values of the RF frequency, the RF amplitude, and the DC voltage is used to determine an m/z value, as described hereinbelow.

Mathieu's equations describe ion motion in the QMF 10 using two reduced parameters, a and q:

$$a = \frac{4zeU_{DC}}{mr_o^2\Omega^2} \tag{1}$$

-continued $$q = \frac{2zeV_{RF}}{mr_o^2\Omega^2} \tag{2}$$

wherein e is the charge of an electron, z is the number of charges on an ion, m is the mass of the ion, $r_o$ is the inscribed radius of the quadrupole rods from the axis 54 to the surface of any one of the cylindrical metal rods 52, $U_{DC}$ is the DC voltage between opposing rods 52 of the QMF 10, $V_{RF}$ is the RF amplitude, defined as a peak-to-peak amplitude, and Ω is the RF frequency as an angular frequency. The RF signal is between opposing rods. An a-q stability diagram is a way of representing combinations of oscillating and static fields that generate stable trajectories through the QMF 10.

Equation 2 can be rearranged to show the dependence of the transmitted m/z on the RF amplitude and RF frequency (f):

$$m/z = \frac{eV_{RF}}{2\pi^2 r_o^2 m_u q f^2}. \tag{3}$$

wherein f is RF frequency, $m_u$ is the atomic mass constant, and m is in units of Daltons.

The frequency is varied by incrementing a divide-by number. The allowed values of the RF frequency are given by:

$$f = \frac{f_{clock}}{2n}, \tag{4}$$

where f is the RF frequency, n is the divide-by number, and $f_{clock}$ is the first frequency generated by the high-frequency clock (570 MHz). The factor of 2 in Equation 4 is due to dividing the TTL signal 206 in the QMF drive circuits 104. M/z is directly proportional to $n^2$ as shown by combining Equations 3 and 4:

$$m/z = \frac{eV_{RF}}{2\pi^2 r_o^2 m_u q}\left(\frac{2n}{f_{clock}}\right)^2. \tag{5}$$

Setting Δ(m/z)=m/z(n+1)−m/z(n), the difference in m/z for neighboring sampling points is:

$$\Delta m/z = 4k[k + (m/z)^{1/2}], \tag{6}$$

$$k = \frac{1}{\pi r_o f_{clock}}\left(\frac{eV_{RF}}{2m_u q}\right)^{1/2}. \tag{7}$$

wherein

Because $(m/z)^{1/2} >> k$, the spacing between sampled m/z values increases with (m/z). In some embodiments, Δm/z may be around 3 Th at $10^3$ Th and may rise to around 30 Th at $10^5$ Th. In addition to the methods for increasing m/z and improving sampling resolution described hereinbelow, various parameters may be varied to increase m/z and improve sampling resolution. In some embodiments, to further improve the sampling resolution, the first frequency is increased, combined with the methods described herein. In further embodiments, the QMF 10 is operated in a third stability region combined with the methods described herein. In still further embodiments, the RF amplitude is lowered to increase the sampling density combined with the methods described herein. In still yet further embodiments, the RF frequency is lowered to allow for detection of larger m/z values combined with the methods described herein.

For each combination of the RF frequency, the RF amplitude, and the DC voltage, an m/z band pass filter results, where the center of a band depends on the RF amplitude and frequency, and width of the band depends on the ratio of the peak-to-peak RF amplitude to the DC voltage between the rods. The ions that pass through the QMF 10 reach a detector and are counted for a preset time (50 ms) to generate an ion count that is transferred to the computer. In some embodiments, the RF frequency, the RF amplitude, and the DC voltage correspond to f, $V_{RF}$, and $U_{DC}$, respectively. In further embodiments, the RF frequency, the RF amplitude, and the DC voltage are adjusted such that the ratio of the RF amplitude to the DC voltage and therefore the q/a ratio is held substantially constant at a preferred ratio. In some embodiments, the preferred ratio is determined by calibrating the apparatus to a standard having known m/z values. In some examples, the DC contribution is eliminated resulting in a value of zero. At the end of the scan an m/z spectrum is generated by the program based on the RF frequency, the RF amplitude, the DC voltage, and the detector output.

Referring now to FIG. 4, a plot illustrating the sequence of events when m/z is scanned by a synchronized frequency and amplitude scan is shown. A primary frequency scan with a superimposed, narrow-range amplitude scan is performed using the QMF 10 to increase sampling resolution compared to only scanning frequency. In some examples, information from the LabVIEW program about the RF frequency, the RF amplitude, the DC voltage, and the pole zero voltage is used to run a method and obtain detection data.

For the smallest m/z value in the plot (leftmost point on the x-axis), a first m/z band pass is created by applying a first RF signal to the QMF 10. The first RF signal has a nominal amplitude and a first frequency. For the next m/z value, a second m/z band is created by maintaining the frequency of the first signal but applying an adjusted amplitude greater than the nominal amplitude. For the next m/z value in the plot, a third m/z band is created by applying a second frequency that is different than the first frequency while returning to the nominal amplitude. Ions are counted by the detector for each of the band pass filters. Therefore, a narrow-range amplitude scan is built on an RF frequency scan by adjusting the RF amplitude at discrete frequencies to sample m/z values between m/z values that would be sampled by a frequency scan alone, increasing the sampling point density. Accordingly, at each RF frequency, the RF amplitude and the DC voltage can be varied to improve the sampling resolution.

In some embodiments, the adjusted RF amplitude is configured to sample an m/z value halfway between the m/z values accessed by two discrete RF frequencies at the nominal amplitude. In further embodiments, several additional m/z values between values accessed by only varying the discrete frequencies are sampled by using more than one adjusted amplitude. In further embodiments, RF amplitude is adjusted at some discrete frequencies in a frequency scan, such as low frequencies, but not all discrete frequencies. In still further embodiments, varying numbers of adjusted RF amplitudes are sampled at various discrete frequencies. An algorithm may be written to determine several adjusted amplitude values for a particular discrete frequency based on the equations disclosed herein to allow for sampling more m/z values.

The RF frequency and the RF amplitude have a different dependence on m/z, and to keep the adjusted m/z points approximately halfway between those obtained with scanning RF frequency the nominal amplitude, the adjusted amplitude changes during the frequency scan (the adjusted amplitude is larger at larger frequency values and hence smaller m/z). Ions are detected at two amplitudes for each frequency, thereby doubling the m/z sampling point density. In some embodiments, the shift between nominal and adjusted amplitude is <0.2%. Therefore, the method may be described as a primary frequency scan with a superimposed, narrow-range (<0.2%) RF amplitude scan that increases sampling resolution. As the RF amplitude is adjusted, the DC voltage is also adjusted to keep the a to q ratio constant during the scan. In some embodiments, the a to q ratio varies over a narrow range (±0.004%). In further embodiments, the RF frequency ranges from 100 kHz to 400 kHz and the RF amplitude is varied near 100 V. In further embodiments, the RF frequency is 300 kHZ. In still further embodiments, the RF frequency range is 0.4 to 1.1 MHz. In still yet further embodiments, the RF frequency range is 2.38 to 2.54 MHz.

Because the RF frequency is the primary quantity scanned, the upper m/z limit can be made arbitrarily large. There is in principle no upper m/z limit when using the methods disclosed herein. By using the trapezoidal waveform 114 to generate oscillating electric fields, the contribution from harmonics can be minimized by adjusting the length of transition times of the trapezoidal waveform 114. The m/z resolving power is better than previous scans, as further described hereinbelow. The computer interface and the digital design of the QMF drive circuits 104 allow flexibility, where the RF frequency, the RF amplitude, and the DC voltage are all easily adjusted variables. The flexibility allows an operator to choose the stability region and to simultaneously scan the RF frequency, the RF amplitude, and the DC voltage. Due to the way in which the waveforms are constructed, there is flexibility in selecting a combination of the RF frequency, the RF amplitude, and the DC voltage that allows easy access to a wide m/z range in both the first and third stability regions. To achieve a high resolving power, the digital signal has low jitter, and the trapezoidal waveform 114 is generated with high fidelity. Advantageously, the quadrupole mass filters 10 described herein are useful with m/z values greater than 2,000 Th. Another advantage of the QMFs 10 described herein is that the QMFs 10 may be used to scan frequency over a well-defined, wide range with useful resolving power. The methods of the present disclosure do not substantially decrease transmission efficiency while scanning.

The present disclosure may be used in several different methods to obtain mass spectral information and is not limited to those described herein. In some embodiments, the QMFs 10 described herein are used to observe electrosprayed protein complexes. In further embodiments, QMFs 10 are used in tandem mass spectrometry (MS) where multiple stages of MS are performed with ion fragmentation occurring between them. In still further embodiments, QMFs 10 are used in triple quadrupole and quadrupole time-of-flight (Q-TOF) instruments, both of which may be used for MS/MS studies. In still yet further embodiments, a commercially available Q-TOF, such as a Waters Q-TOF, may be used with the methods described herein.

EXAMPLES

Simulation of the Stability Diagram for a QMF Driven by a Trapezoidal Wave.

Figure 5:
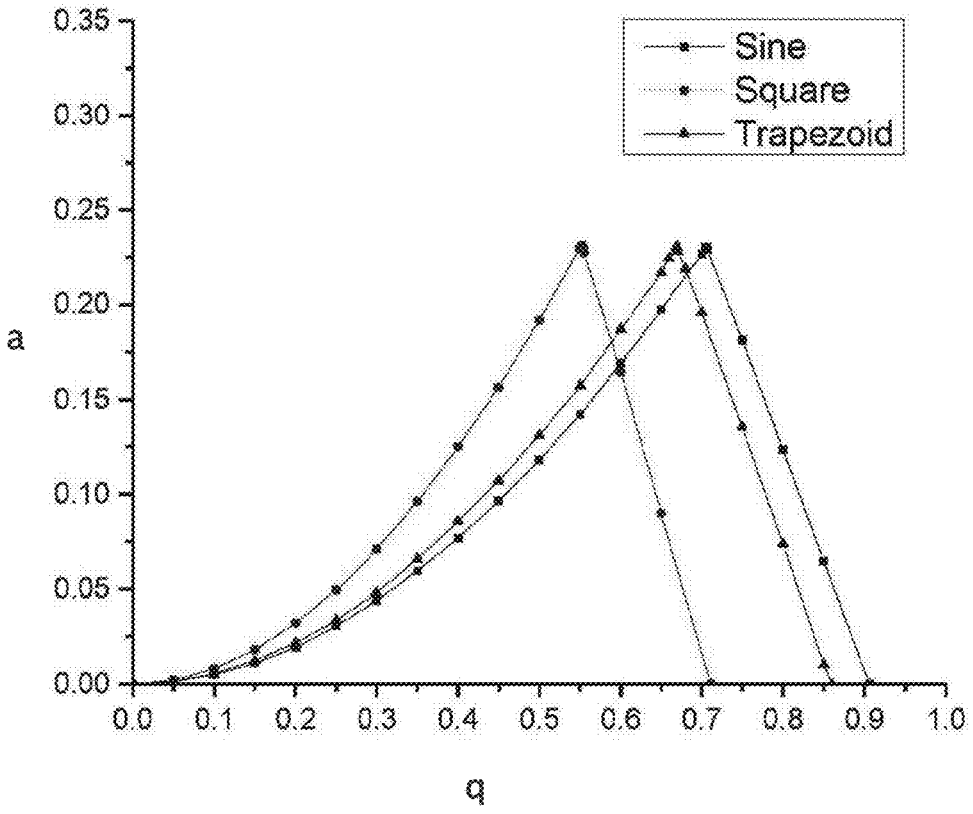
FIG. 5 is a plot of first stability regions for sine, square, and trapezoid waveforms.

An a-q stability diagram was generated to represent the combinations of oscillating and static fields that generate stable trajectories through the QMF 10. Information from the stability diagram was used to set the resolving power (i.e., set the ratio of the DC voltage to the RF amplitude) and to transform the frequencies and amplitudes to an m/z scale using the equations described herein. SIMION® 8.1, commercially available from Scientific Instrument Services, Inc. was used to map a first stability region for the trapezoidal wave 114. A stability region is a region of q and a values wherein an ion can pass through a QMF 10. A fraction of the ions transmitted was modeled as a function of the DC voltage between the rods for a range of q-values from 0.05 to about 0.91. The derivative of each transmission plot was calculated and plotted. The DC voltage at a point of greatest change was deemed to be the point of instability, and the DC voltage directly preceding the point of greatest change was assigned to be a limit of the stability region. Once the DC voltage at each q-value was determined for the edge of the stability region, corresponding a-values were calculated. Values for q, f (Hz), DC voltage (V), and a for sinusoidal waves, square waves, and trapezoidal waves are shown in Table 1. The values were determined where m/z is 1000 Th, e is $1.6022\times10^{-19}$ coulombs, $V_{RF}$ is 100 V, and $r_o$ is 4.1485 mm. The edge of the stability region was plotted, as shown in FIG. 5. Data points for the trapezoid wave (see Table 2) are shown as triangular points, data points for the sin wave (see Table 1) are shown as square points, and data points for the square wave (see Table 1) are shown as circular points. The stability regions for the trapezoidal wave, the sine wave, and the square wave have roughly triangular shapes. Combinations of q and a points within each triangle are stable solutions, while those outside are unstable.

TABLE 1

Stability Region Data from Simulation for Sinusoidal and Square Waveforms

| | | sine wave | | square wave | |
|---|---|---|---|---|---|
| q | F | DC voltage | A | DC voltage | a |
| 0.05 | 1065892.291 | 1.2 | 0.0012 | 2 | 0.002 |
| 0.1 | 753699.6671 | 2.4 | 0.0048 | 4 | 0.008 |
| 0.15 | 615393.2012 | 3.6 | 0.0108 | 6 | 0.018 |
| 0.2 | 532946.1456 | 4.8 | 0.0192 | 8 | 0.032 |
| 0.25 | 476681.5239 | 6.1 | 0.0305 | 9.9 | 0.0495 |
| 0.3 | 435148.7057 | 7.3 | 0.0438 | 11.8 | 0.0708 |
| 0.35 | 402869.4181 | 8.5 | 0.0595 | 13.7 | 0.0959 |
| 0.4 | 376849.8335 | 9.6 | 0.0768 | 15.6 | 0.1248 |
| 0.45 | 355297.4304 | 10.7 | 0.0963 | 17.4 | 0.1566 |
| 0.5 | 337064.738 | 11.8 | 0.118 | 19.2 | 0.192 |
| 0.549 | 321671.1793 | | | 20.9 | 0.229482 |
| 0.55 | 321378.6179 | 12.9 | 0.1419 | 20.9 | 0.2299 |
| 0.551 | 321086.8533 | | | 20.9 | 0.230318 |
| 0.552 | 320795.8819 | | | 20.9 | 0.230736 |
| 0.553 | 320505.7002 | | | 20.9 | 0.231154 |
| 0.554 | 320216.3044 | | | 20.8 | 0.230464 |
| 0.555 | 319927.6912 | | | 20.5 | 0.22755 |
| 0.6 | 307696.6006 | 14.1 | 0.1692 | 13.7 | 0.1644 |
| 0.65 | 295625.3315 | 15.2 | 0.1976 | 6.9 | 0.0897 |
| 0.66 | 293377.1975 | | | | |
| 0.669 | 291397.1263 | | | | |
| 0.67 | 291179.5846 | | | | |
| 0.671 | 290962.5293 | | | | |
| 0.68 | 289030.6284 | | | | |
| 0.7 | 284871.6975 | 16.2 | 0.2268 | | 0 |
| 0.705 | 283859.7167 | 16.3 | 0.22983 | | 0 |
| 0.706 | 283658.6116 | 16.3 | 0.230156 | | 0 |
| 0.707 | 283457.9334 | 16.2 | 0.229068 | | 0 |
| 0.71 | 282858.4447 | | | | 0 |

TABLE 1-continued

Stability Region Data from Simulation for Sinusoidal and Square Waveforms

| | | sine wave | | square wave | |
|---|---|---|---|---|---|
| q | F | DC voltage | A | DC voltage | a |
| 0.711 | 282659.4588 | | | 0 | 0 |
| 0.75 | 275212.2062 | 12.1 | 0.1815 | | |
| 0.8 | 266473.0728 | 7.7 | 0.1232 | | |
| 0.85 | 258516.8531 | 3.8 | 0.0646 | | |
| 0.859 | 257159.0078 | | | | |
| 0.86 | 257009.4533 | | | | |
| 0.906 | 250399.9424 | 0 | 0 | | |
| 0.908 | 250124.0195 | 0 | 0 | | |
| 0.91 | 249849.0067 | 0 | 0 | | |

TABLE 2

Stability Region Data from Simulation for Trapezoidal Waveform

| | | trapezoid wave | |
|---|---|---|---|
| q | F | DC voltage | a |
| 0.05 | 1065892.291 | 1.3 | 0.0013 |
| 0.1 | 753699.6671 | 2.7 | 0.0054 |
| 0.15 | 615393.2012 | 4.1 | 0.0123 |
| 0.2 | 532946.1456 | 5.4 | 0.0216 |
| 0.25 | 476681.5239 | 6.7 | 0.0335 |
| 0.3 | 435148.7057 | 8 | 0.048 |
| 0.35 | 402869.4181 | 9.4 | 0.0658 |
| 0.4 | 376849.8335 | 10.7 | 0.0856 |
| 0.45 | 355297.4304 | 11.9 | 0.1071 |
| 0.5 | 337064.738 | 13.1 | 0.131 |
| 0.549 | 321671.1793 | | |
| 0.55 | 321378.6179 | 14.3 | 0.1573 |
| 0.551 | 321086.8533 | | |
| 0.552 | 320795.8819 | | |
| 0.553 | 320505.7002 | | |
| 0.554 | 320216.3044 | | |
| 0.555 | 319927.6912 | | |
| 0.6 | 307696.6006 | 15.6 | 0.1872 |
| 0.65 | 295625.3315 | 16.7 | 0.2171 |
| 0.66 | 293377.1975 | 17 | 0.2244 |
| 0.669 | 291397.1263 | 17.2 | 0.230136 |
| 0.67 | 291179.5846 | 17.2 | 0.23048 |
| 0.671 | 290962.5293 | 17 | 0.22814 |
| 0.68 | 289030.6284 | 16.1 | 0.21896 |
| 0.7 | 284871.6975 | 14 | 0.196 |
| 0.705 | 283859.7167 | | |
| 0.706 | 283658.6116 | | |
| 0.707 | 283457.9334 | | |
| 0.71 | 282858.4447 | | |
| 0.711 | 282659.4588 | | |
| 0.75 | 275212.2062 | 9 | 0.135 |
| 0.8 | 266473.0728 | 4.6 | 0.0736 |
| 0.85 | 258516.8531 | 0.6 | 0.0102 |
| 0.859 | 257159.0078 | | |
| 0.86 | 257009.4533 | 0 | 0 |
| 0.906 | 250399.9424 | | |
| 0.908 | 250124.0195 | | |
| 0.91 | 249849.0067 | | |

In some embodiments, QMFs 10 are operated near an apex of one of the triangles. The apex of the first stability region for the sine wave was found to be at (0.706, 0.230), which compares to an experimental value (0.70601, 0.23697) reported by Paul, et al., *Z. Phys.* 152, 143-182 (1958). The apex for the simulated square wave was found to be (0.553, 0.231), which compares to the experimental value of (0.586, 0.237) reported by Richards, et al., *Int. J. Mass Spectrom. Ion Phys.* 12, 317-339 (1973). The apex of the stability diagram for the trapezoid wave was found to be (0.670, 0.230). The stability diagram for the trapezoidal wave was closer to the sine wave than the square wave because the trapezoidal wave used here was optimized to minimize harmonics and hence provide an approximation to a sine wave. In the examples described below, the q-value of the apex for the trapezoidal wave was used to provide an initial calibration for the m/z scale and the a-value at the apex was used as a guide to set the resolving power.

Materials and Methods.

The following materials and methods were used in all Examples unless otherwise noted. The QMF 10 was characterized by electrospraying a CsI solution that generated a wide distribution of cluster sizes. A cesium iodide (Sigma Aldrich, 99.999%) solution was prepared at a concentration of 15 mg/mL in 50:50 water (EDM Millipore) and ethanol (AAPER Alcohol) and electrosprayed at 10 μL/hr. LabVIEW, available from National Instruments Corporation, was used to control the RF amplitude, RF frequency and DC voltage applied to the QMF 10. The cesium iodide solution was ionized with a voltage of +1.8 kV. The electrospray tip 16 was 0.5 cm off-axis from the stainless steel capillary 18. A +260 V potential was applied to the stainless steel capillary 18. Opposite phases of an RF signal (300 V peak-to-peak amplitude, 141 kHz frequency) were applied to the long drift region 24. The DC gradient in the long drift region 24 was 1.05 V/cm. +208 V was applied to the first ring electrode at the first end 24 of the long drift region 24 and +176 V was applied to the last ring electrode at the second end 28 of the long drift region 24. A voltage of +197 V was applied to the jet disrupter 32. A voltage of +274 V was applied to the outermost ring electrode of the DC ion carpet 30 while 0 V was applied to the innermost ring electrode of the DC ion carpet 30. The RF signal applied to the hexapole 36 had a 200 V peak-to-peak amplitude and a 285 kHz frequency with a +8V DC offset relative to the QMF pole zero. The einzel lens 50 had a voltage of −58 V. The collision dynode 56 had a −7 kV voltage. The microchannel plates had a +2.2 kV voltage. The first differentially pumped region had a pressure of 685 mTorr. The second differentially pumped region had a pressure of 110 mTorr. The third differentially pumped region had a pressure of $6.6\times10^{-5}$ Torr. The fourth differentially pumped region had a pressure of $1.7\times10^{-6}$ Torr. The pressures in the first and second differentially pumped regions were found to be suitable for the efficient transmission of large ions. Using the pressures recited herein, large ions were properly thermalized and ions did not diffuse away.

The LabVIEW program used information including frequency, amplitude, DC voltage, and pole zero voltage to operate the QMF 10 and obtain detection data. Amplitude and DC voltage were varied in units of −1.4 mV by the 18-bit DACs used to control the power supplies. Although it is not possible to keep the ratio of the amplitude to DC voltage exactly the same throughout a scan, the ratio varies over a very narrow range (±0.004%) for the m/z values of interest. Frequency was scanned at various ranges between about 500 MHz to 12 kHz based on the apparatus described herein. Using 12 kHz as the RF frequency applied to the QMF with a peak-to-peak amplitude of 400 V leads to an m/z value of about 1.2 MTh. Higher m/z values may be obtained by small modifications to the filter. Using 500 kHz as the RF frequency 400 V as the peak-to-peak amplitude, the lower m/z value is about 700 Th. The frequency may be increased by reducing the current pulse length in the drive circuit. Also, m/z may be lowered by lowering the RF amplitude or by operating in the third stability region (or both). When the RF amplitude is 200 V and the RF frequency is 500 kHZ, m/z is about 350 Th. When the RF amplitude is 200 V and the RF frequency is 500 kHZ, m/z is about 80 Th in the third stability region. Therefore, the methods described herein are compatible with higher and lower frequencies.

All m/z spectra described in the Examples were collected in the first stability region with the nominal amplitude of 200 V peak-to-peak. The adjusted amplitude for a given frequency was determined by calculating an amplitude that would provide an m/z value halfway between the m/z value resulting from the given frequency at the nominal amplitude and the m/z value resulting from a next frequency in the scan method at the nominal amplitude.

Experimental Generation of the Stability Diagram for a QMF Driven by a Trapezoidal Wave.

The frequency scale that was used to measure the data was converted to an m/z scale. This conversion was initially performed using the stability diagram simulations described above. Specifically, the q-value at the apex of the first stability region for the trapezoidal wave (0.670) was used to provide an initial calibration. The m/z scale was refined using the known masses of the measured peaks. An experimental value for q at the apex was 0.651.

Example 1. M/z Spectrum for CsI Clusters Up to 20,000 Th

Figure 6:
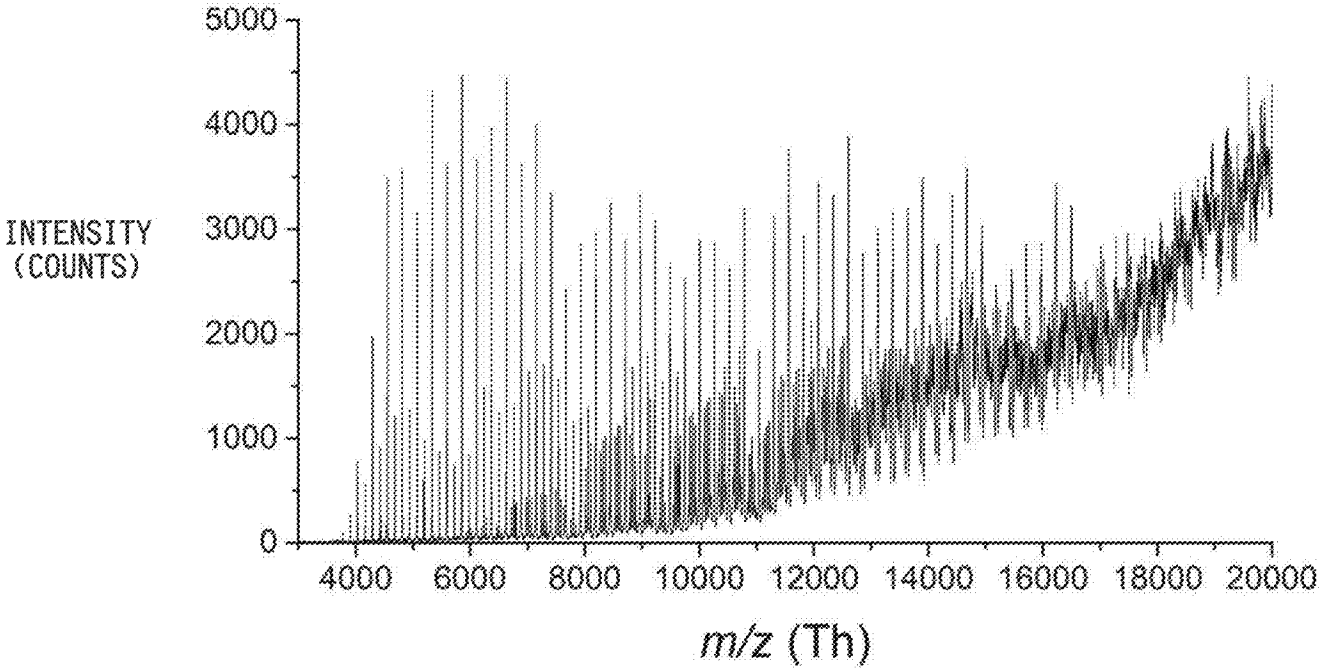
FIG. 6 is a mass spectrum generated with a quadrupole mass filter, measured for CsI clusters up to 20,000 Th.

Electrosprayed CsI clusters were studied over a wide range of m/z values using the QMF 10 of the present disclosure. An m/z spectrum measured for CsI clusters up to 20,000 Th is shown in FIG. 6. Peaks due to the $(CsI)_nCs^+$ sequence were evident up to about 16,500 Th. The positively charged CsI clusters observed comprise a number of CsI units along with one or more excess $Cs^+$ ions that provide the overall charge. Singly charged clusters occurred at m/z values corresponding to $(CsI)_nCs^+$ and doubly charged clusters occurred at m/z values corresponding to $(CsI)_{2n}Cs_2^{2+}$ and $(CsI)_{2n+1}Cs_2^{2+}$. The doubly charged $(CsI)_{2n}Cs_2^{2+}$ clusters had the same m/z as the singly charged $(CsI)_nCs^+$ clusters, while the m/z for doubly charged $(CsI)_{2n+1}Cs_2^{2+}$ ions was halfway between two neighboring singly charged clusters. Triply charged clusters had m/z values corresponding to the following combinations: $(CsI)_{3n}Cs_3^{3+}$ $(CsI)_{3n+1}Cs_3^{3+}$, and $(CsI)_{3n+2}Cs_3^{3+}$. The triply charged $(CsI)_{3n}Cs_3^{3+}$ had the same m/z as singly charged $(CsI)_nCs^+$ and doubly charged $(CsI)_{2n}Cs_2^{2+}$, while the other triply charged clusters, $(CsI)_{3n+1}Cs_3^{3+}$ and $(CsI)_{3n+2}Cs_3^{3+}$, occurred at m/z values ⅓ and ⅔ of the way between two neighboring singly charged clusters. As charge increased, clusters followed the pattern outlined above.

In FIG. 6, there was a progression of peaks due to a sequence of $(CsI)_nCs^+$ ions that extended up to about 16,501 Th (n=63). For low m/z values, the $(CsI)_nCs^+$ peaks were due to singly charged clusters, but for higher m/z values multiply charged clusters: $(CsI)_{2n}Cs_2^{2+}$, $(CsI)_{3n}Cs_3^{3+}$, etc. (which have the same m/z) became increasingly important. Doubly charged clusters emerged at $(CsI)_{21}Cs_2^{2+}$ (2,861 Th), which was in agreement with the size range predicted for the emergence of doubly charged alkali halide clusters in the calculations of Martin et al., *J. Chem. Phys.* 76, 5467-5469 (1982).

Figure 7A:
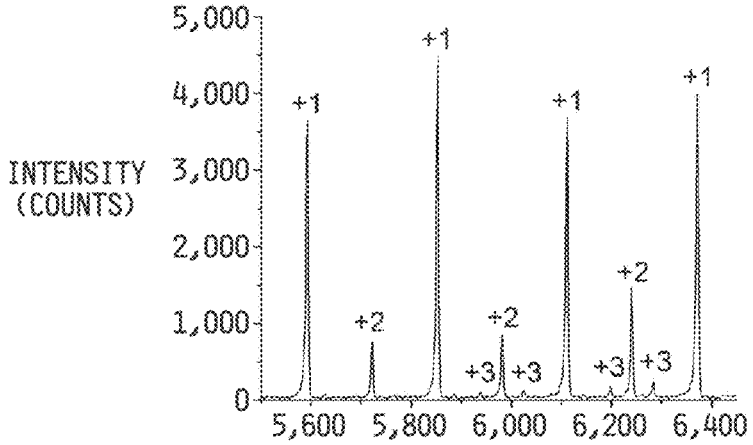
FIG. 7A is an expanded view of the mass spectrum of FIG. 6 centered around 6,000 Th.

An expanded view of the m/z spectrum around 6,000 Th that shows the onset of CsI clusters with a charge of +3 beginning with $(CsI)_{67}Cs_3^{3+}$ at 5,935 Th is shown in FIG. 7A. Singly and doubly charged clusters were easily identified in this m/z range and are labeled in FIG. 7A.

Figure 7B:
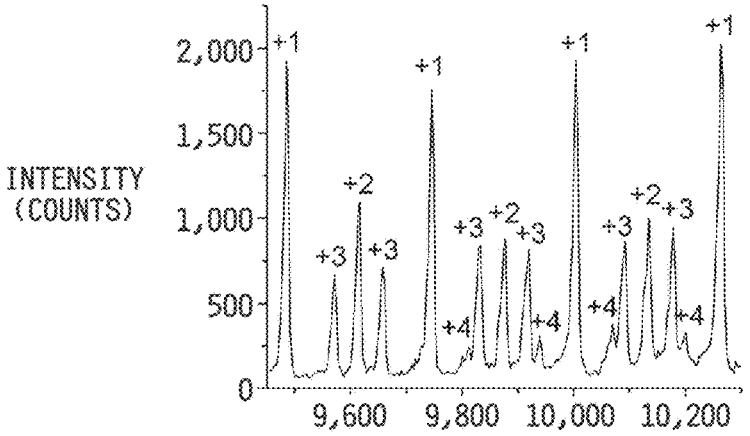
FIG. 7B is an expanded view of the mass spectrum of FIG. 6 centered around 10,000 Th.

An expanded view of the m/z spectrum around 10,000 Th showing the onset of clusters with a charge of +4, beginning with $(CsI)_{149}Cs_4^{4+}$ at 9,811 is shown in FIG. 7B. Sums of intensities of doubly charged peaks due to $(CsI)_{2n+1}Cs_2^{2+}$ ions (which are labelled +2 in the Figure) and sums of intensities of triply charged peaks due to $(CsI)_{3n+1}Cs_3^{3+}$ or $(CsI)_{3n+2}Cs_3^{3+}$ ions (labelled +3) were comparable to the intensities of peaks for singly charged $(CsI)_nCs^+$ clusters (labelled +1). The peaks labelled +1 in FIG. 7B may be due to doubly charged $(CsI)_{2n}Cs_2^{2+}$ ions and triply charged $(CsI)_{3n}Cs_3^{3+}$ ions with a small amount of singly charged $(CsI)_nCs^+$ ions. Well-resolved multiply charged clusters were easily identified up to about 12,000 Th. At larger m/z values, higher charge states appeared, resolution among the multiple charge states was lost, and the baseline increased.

Figure 7C:
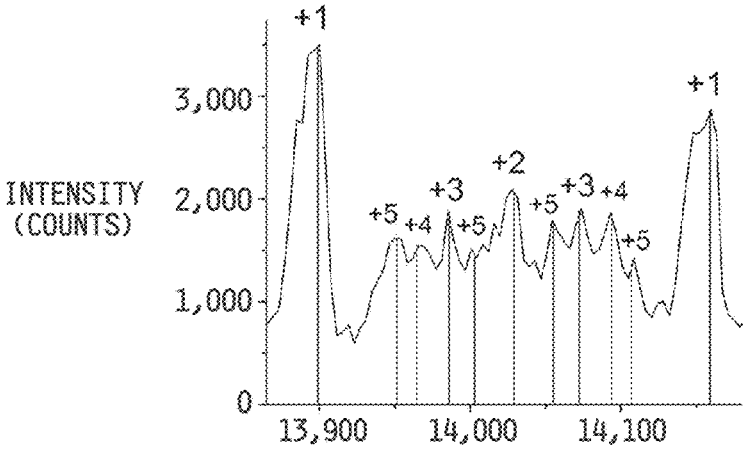
FIG. 7C is an expanded view of the mass spectrum of FIG. 6 centered around 14,000.

An expanded view of the m/z spectrum around 14,000 Th showing the presence of $(CsI)_nCs_2^{z+}$ clusters up to z=5 is shown in FIG. 7C. In this portion of the spectrum, the peaks labelled +1 may have had contributions from $(CsI)_nCs^+$, $(CsI)_{2n}Cs_2^{2+}$, $(CsI)_{3n}Cs_3^{3+}$, $(CsI)_{4n}Cs_4^{4+}$, $(CSI)_{5n}Cs_5^{5+}$, etc. which all have the same m/z. Contributions from the singly charged $(CsI)_nCs^+$ clusters and possibly also the doubly charged $(CsI)_{2n}Cs_2^{2+}$ clusters were small at around 14,000 Th and higher charge states were mainly responsible for the peaks labelled +1 in FIG. 7C. For m/z values between 16,500 and 20,000 Th, it was still possible to identify peaks at m/z values corresponding to the $(CsI)_nCs^+$ sequence. As m/z increased, the background was probably the result of unresolved multiply charged clusters as well as clusters that are incompletely desolvated or contained impurities. Resolution was limited above 20,000 Th, partly because of congestion due to overlapping multiply charged clusters.

Example 2. M/z Spectrum for CsI Clusters Up to 200,000 Th

Conditions for Example 2 were the same as conditions described in Materials and Methods, except that ESI tip 16 was directly in line with capillary 18.

Figure 8:
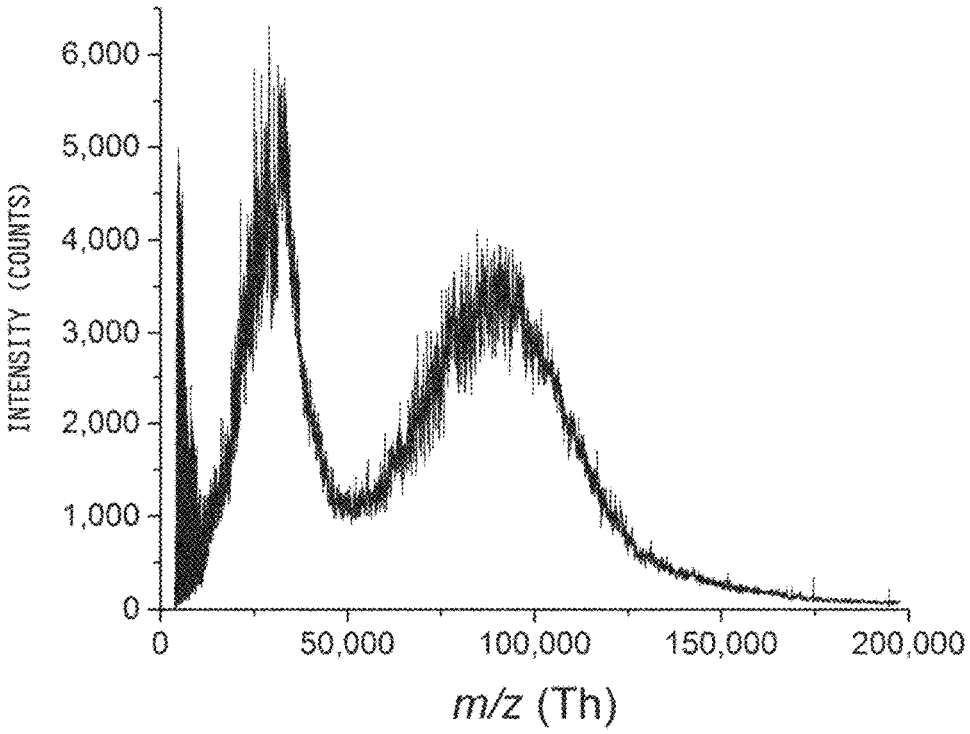
FIG. 8 is a mass spectrum generated with a quadrupole mass filter, measured up to 200,000 Th.
Figure 10:
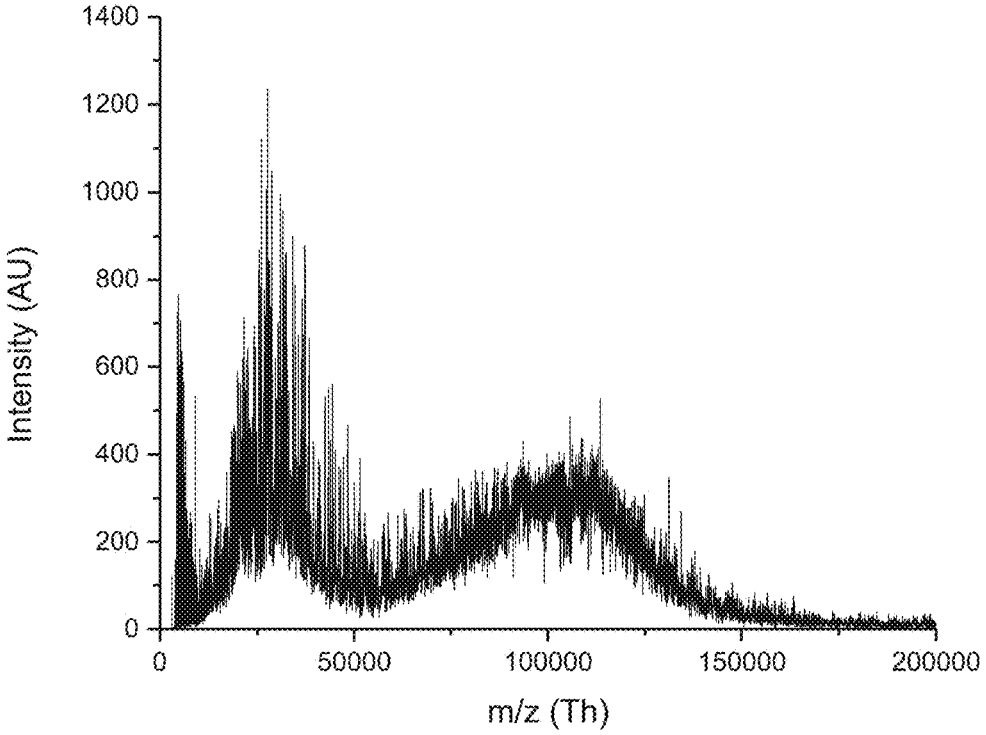
FIG. 10 is a mass spectrum generated with a quadrupole mass filter, measured for CsI clusters up to 200,000 Th with a 15 V hexapole DC offset.
Figure 11:
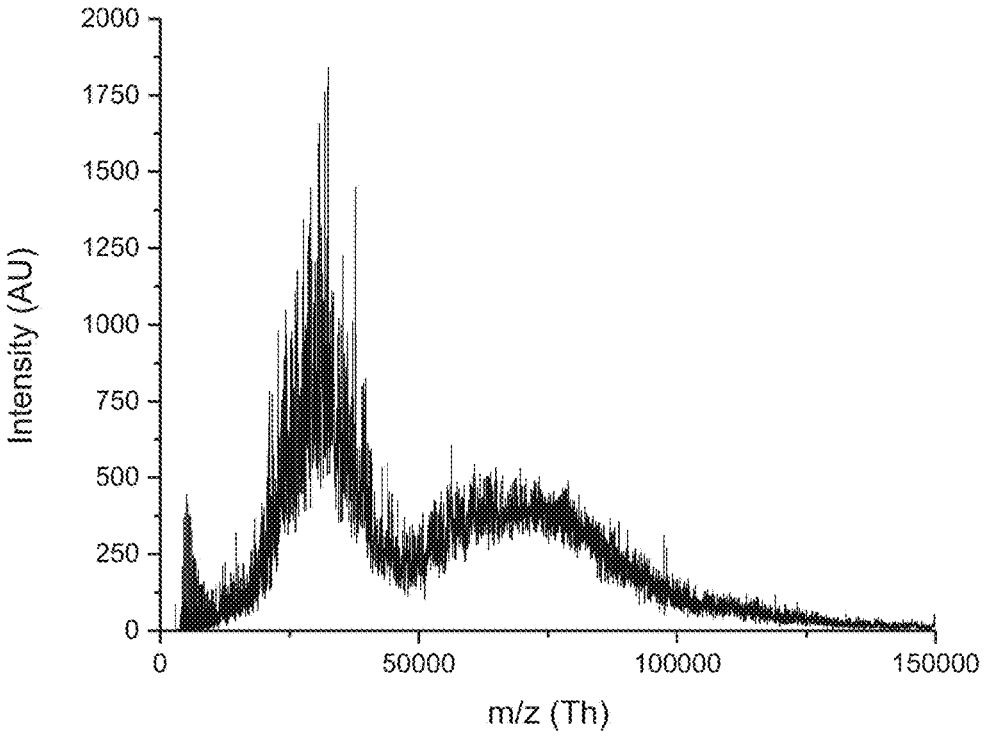
FIG. 11 is a mass spectrum generated with a quadrupole mass filter, measured for CsI clusters up to 200,000 Th with a 0 V hexapole DC offset.

A spectrum measured for m/z values up to 200,000 Th is shown in FIG. 8. In this spectrum, there was a first broad feature centered at about 32,000 Th and a second broad feature centered at about 95,000 Th. The centers of these features can be manipulated by adjusting the pressure in the thermalization cell, the hexapole frequency, the hexapole, and the QMF pole zero potential. For example, by changing the DC offset of the hexapole 36 from +8V to +15V, the first broad feature was centered at about 32,000 Th and the second broad feature was centered at about 110,000 Th, as shown in FIG. 10. By changing the DC offset of the hexapole 36 to 0 V, the first broad feature was centered at about 31,000 Th and the second broad feature was centered at about 71,000 Th, as shown in FIG. 11. The broad features may predominantly represent multiply charged cesium iodide nanocrystals.

Resolving Power.

Figure 9:
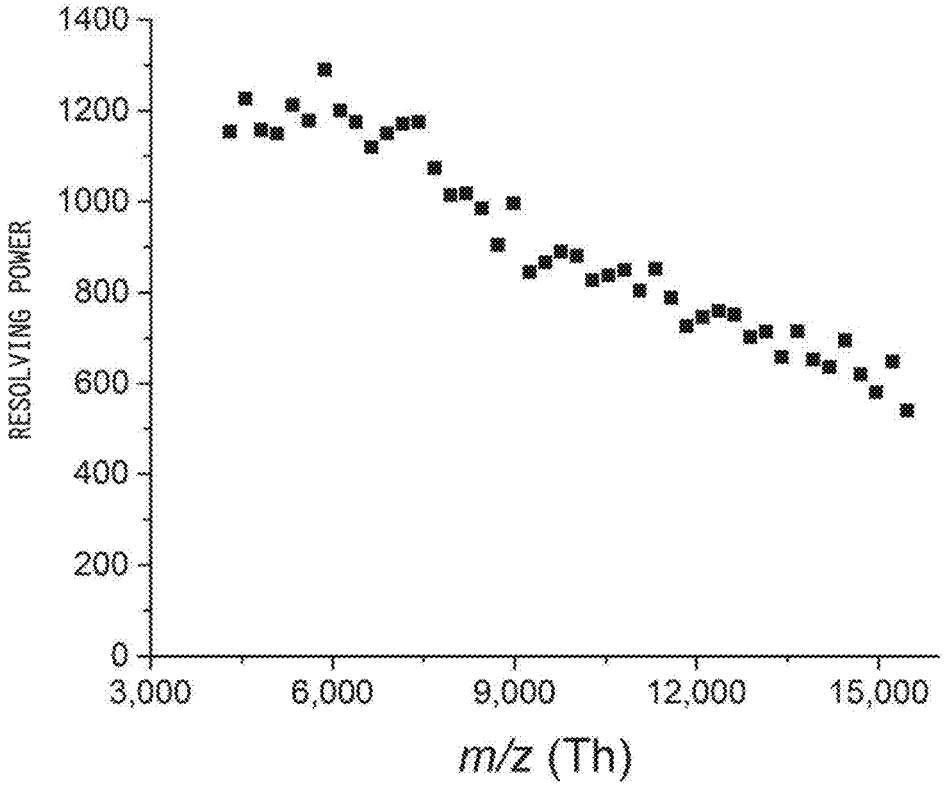
FIG. 9 is a plot of resolving power determined for a $(CsI)_nCs^+$ sequence of peaks as a function of m/z.

The resolving power, $(m/z)/\Delta(m/z)$, was determined for the peaks corresponding to the $(CsI)_nCs^+$ sequence in the m/z spectrum of Example 1. At low m/z the peaks were mainly due to singly charged clusters, but multiply charge $(CsI)_{zn}Cs_z^{z+}$ clusters became dominant at higher m/z. Each peak was fit with a Gaussian function using OriginPro 9.0, commercially available from OriginLab Corporation, and the FWHM was determined from the resulting standard deviation. The resolving powers were plotted against m/z, as shown in FIG. 9. The resolving power remained constant at about 1,200 for measurements up to about 7,500 Th and gradually decreased to about 600 for measurements at 15,000 Th.

Nevertheless, for the method of the present disclosure, at least in principle, the resolving power should be independent of frequency and m/z. If the ratio of the amplitude of the trapezoidal wave to the DC offset is fixed, and with a and q values close to the tip of the stability diagram, the resolving power is expected to be proportional to $N^2$ where N is the number of cycles experienced by the ions as they travel through the QMF 10. If the ions all had the same velocity, as the frequency is lowered, the number of cycles they experience would decrease. However, the ions do not have the same velocity; ideally, they have the same energy per charge (because in each example they were all accelerated through the same potential difference before entering the QMF). Equation 8 relates the number of cycles an ion experiences (N) to the frequency, the potential difference (V) through which the ions are accelerated, and the length of the QMF (L):

$$N = Lf\left(\frac{m/z}{2eV}\right)^{1/2}. \tag{8}$$

From Equation 3, m/z is proportional to $1/f^2$; consequently, the number of cycles the ions experience when they are transmitted by the QMF is constant. Hence the resolving power should be independent of frequency and m/z.

The decrease in resolving power may be due to incomplete thermalization of large ions in the hexapole 36 such that the ions enter the QMF 10 with excess kinetic energy. Ions with excess kinetic energy travel through the QMF 10 more quickly, experience fewer cycles, and consequently the resolving power is lower. The presence of excess kinetic energy was confirmed by experiments where the QMF was operated as a crude retarding potential difference energy analyzer whereby the pole zero was raised (made more positive) until the ion signal disappeared. Incomplete dehydration and impurities also may contribute to the widths of the peaks at high m/z values.

Example 3. M/z Spectrum for CsI Ions Between 0 Th and 4000 Th

Conditions for Example 3 were the same as conditions described in Materials and Methods, except for the following modifications: The DC gradient in the long drift region 24 was 2.13 V/cm. +230 V was applied to the first ring electrode at the first end 26 of the long drift region 24 and +165 V was applied to the last ring electrode at the second end 28 of the long drift region 24. A voltage of +227 V was applied to the jet disrupter 32. A voltage of +270 V was applied to the outermost ring electrode of the DC ion carpet 30 while 0 V was applied to the innermost ring electrode of the DC ion carpet 30. In place of the hexapole, an einzel lens, followed by a skimmer, guided the ions to the QMF. There was no einzel lens directly before the QMF 10. A voltage of −84 V was applied to the skimmer. The first differentially pumped region had a pressure of 500 mTorr. The second and third differentially pumped regions were replaced by the skimmer differentially pumped region, which had a pressure of $2\times10^{-5}$ Torr. The fourth differentially pumped region had a pressure of $3\times10^{-7}$ Torr.

Figure 12:
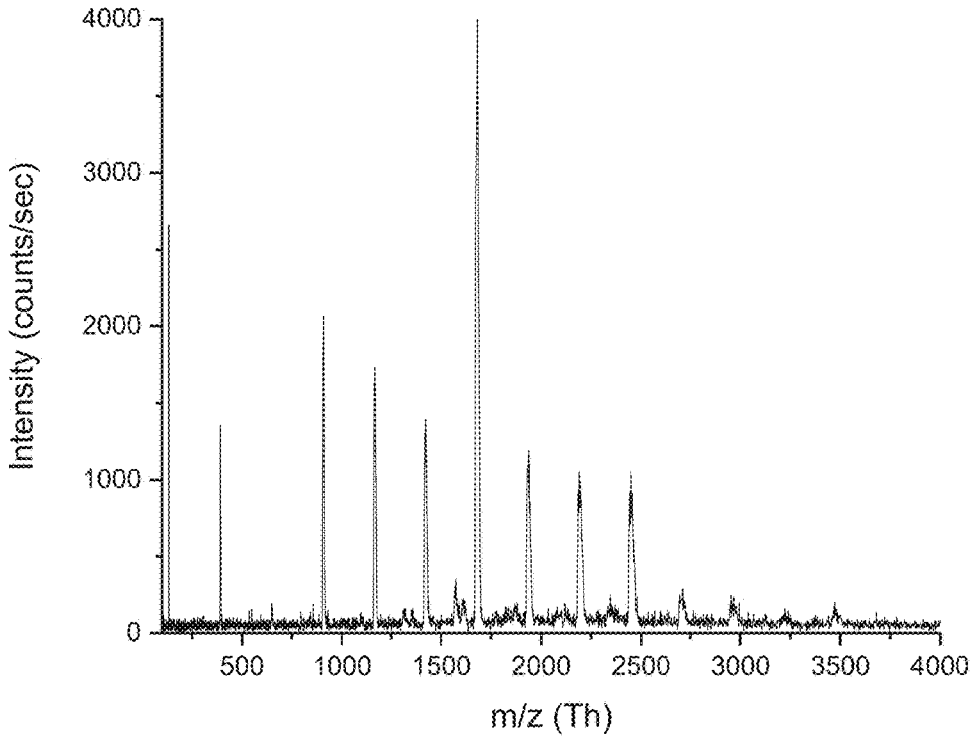
FIG. 12 is a mass spectrum generated with a quadrupole mass filter, measured for CsI clusters between 0 Th and 4000 Th.

A spectrum measured for m/z values up to 0 Th and 4000 Th is shown in FIG. 12. When the pressures in the first and second differentially pumped regions were lowered to encourage low m/z transmission, singly charged clusters can be observed all the way down to $Cs^+$ (132.9 Th).

Example 4. LabVIEW Program and Hardware Connections for the Frequency Scanned Quadrupole System The purpose of the LabVIEW program is to operate and acquire data from the QMF. Based on user input and the Mathieu equations, the program calculates the appropriate digital signals to generate, allowing the waveform frequency and potentials to pass a particular m/z.

The program is structured as a state machine, where there are different "states", or blocks of code, that operate within a loop. Five different states were chosen to represent the main code of the program: start-up, idle, initialize, scan, and shut down. The start-up state initializes the primary components of the data acquisition boards and prepares the program for operation. Main parameters, such as the waveform voltages and various program settings, are loaded from a text file to initialize the variables. This allows the program to begin with the same settings as when it last ran. The idle state is the default state when not generating a mass spectrum. In this state, the focus m/z is set, the waveform voltages can be changed, and spectra can be saved to a file or printed. A sub-menu can also be accessed, allowing for advanced scanning options to be adjusted, such as scanning speed and number of m/z points to increment. The initialize state begins once the "scan" option is selected, and is used to prepare the program and hardware for collecting a spectrum. Arrays are allocated and calculations are performed to generate the array of digital bits that are scanned out to manipulate the digital waveform. The main parameters are saved in a text file. The scan state writes out the digital bits to scan the frequency and/or RF amplitude and records the counted pulses from ion detection events. The shut down state safely stops the data acquisition board background processes and exits the program.

A variation of the Mathieu equations is used to calculate the appropriate frequency and pole voltages based on the desired m/z and RF amplitude. Because of the digitization in these values, the user input variables are rounded to the nearest binned value. These values are converted into the appropriate digital information that is to be written by the D I/O banks on the data acquisition hardware. Through these calculations, a 24-bit divide-by integer is converted into an array of 16-bit integers that are scanned out by the D I/O bank. The frequency data, waveform pole voltage data, and their respective clock and latch lines are all integrated into the 16-bit integer array, where the information is scanned out simultaneously. Of the 16 D I/O lines available in the D I/O port, 9 lines are occupied.

Two data acquisition cards were chosen to interface between the computer and the custom electronics. A Measurement Computing USB-4301 counter/timer board was chosen to generate the series of timing signals for synchronization and to count pulses from the MCPs. A Measurement Computing PCI-2517 multifunction board was chosen to write out the digital bits that control the waveform frequency and potentials, allowing the quadrupole waveform to be scanned to generate an m/z spectrum. LabVIEW drivers were included with the hardware.

Figure 13:
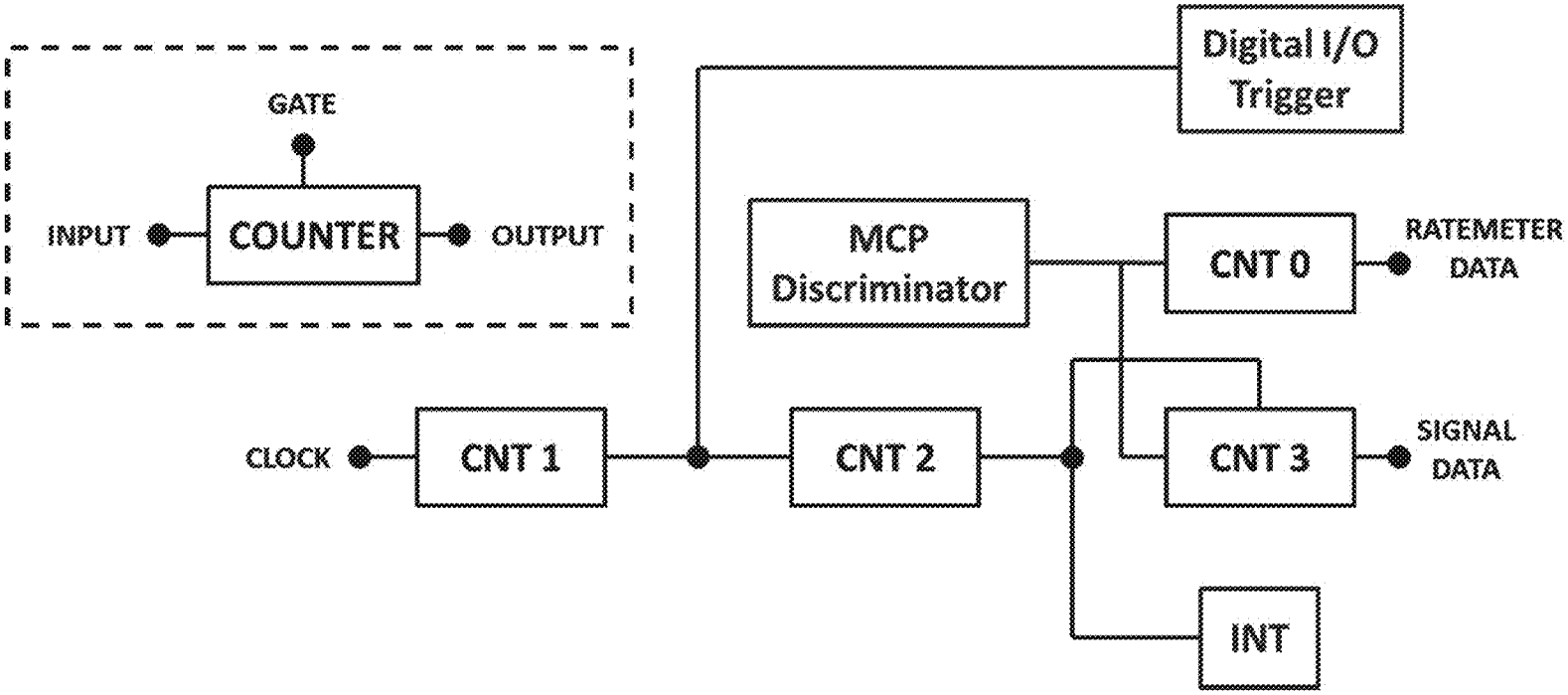
FIG. 13 is a schematic view showing a timing scheme used with data acquisition boards that receive information from a computer with a LabView program that drives the quadrupole mass filter of FIG. 1.

The USB-4301 board features five 16-bit, 20 MHz CTS9513-2 counters. These counters have a timing resolution of 50 ns and allow for the counting to be "paused" when changing m/z points. The counters also have separate "load" and "hold" registers, allowing the counter to decrement from two different values. This feature allows for a timing signal with a variable duty cycle to be generated on the terminal count of the registers. A series of counters on the USB-4301 board are cascaded to generate a series of timing signals to synchronize data counter with the frequency and waveform voltage digital output. This synchronization ensures that the data counter is gated (and not counting) when the quadrupole waveform is changing potential or frequency. This also allows for the data counter to collect data after the waveform potentials have settled. FIG. 13 diagrams the timing scheme and Table 3 notes the functions of the various components.

TABLE 3

External connections on the data acquisition boards.

| Component/Pin | Board | Pin Label | Function |
|---|---|---|---|
| Counter #1 | USB-4301 | CNT 1 | Generate timer #1; D I/O trigger; input for counter #2 |
| Counter #2 | USB-4301 | CNT 2 | Generate timer #2; trigger interrupt; gate data counter |
| Data Counter | USB-4301 | CNT 3 | Count and bin pulses from discriminator |
| Interrupt | USB-4301 | INT | Interrupt pin to monitor scan process |
| PCI Counter | PCI-2517 | CNT 0 | Counter for digital ratemeter |
| D I/O Trigger | PCI-2517 | XDPCR | D I/O trigger for writing digital data |
| D I/O | PCI-2517 | A0-A5 | 6 pins—waveform potential digital output |
| D I/O | PCI-2517 | B5-B7 | 3 pins—waveform frequency digital output |

The counter cascade is initiated with a 1 MHz clock as the input to counter #1. This counter is loaded with a number to divide the frequency of the input clock to generate a timer signal (timer #1). Timer #1 is used as the trigger signal that determines when the digital data in the D I/O is written out. The divide-by number is chosen based on the scan rate and scan mode of the quadrupole. The scan rate is determined by the count time (time to remain at a particular m/z to count pulses) and the dead time (time without counting to adjust the waveform frequency and/or amplitude and wait for the waveform voltages to settle). A count time and dead time of 50 ms each may be used, but this can be adjusted by the user.

Timer #1 is also passed as the input to counter #2, where timer #2 is generated as an output. Timer #2 is a low frequency timer signal with a variable duty factor. This counter has a load and hold register, where it can alternate counting between two divide-by numbers, which correspond to the count time and dead time. This counter gates the data counter and signals the program, via the interrupt pin, on how many m/z points have been written out. The time the output of the counter remains high is the count time of the data counter, while the time it remains low is the dead time. When the counter #2 output transitions from high to low, the data counter stops counting and the waveform frequency/voltage information is latched, adjusting the waveform for the next m/z point.

Signal from the dual MCP/collision dynode detector is amplified with an Ortec preamplifier and converted into a TTL signal with a pico-timing discriminator. This signal is measured with counter #3 on the USB-4301 board during scans and by counter #0 on the PCI-2517. The data from counter #0 is counted and binned continuously in its own thread, allowing for a digital ratemeter to operate both during m/z scans and when the program is idle.

Figure 14:
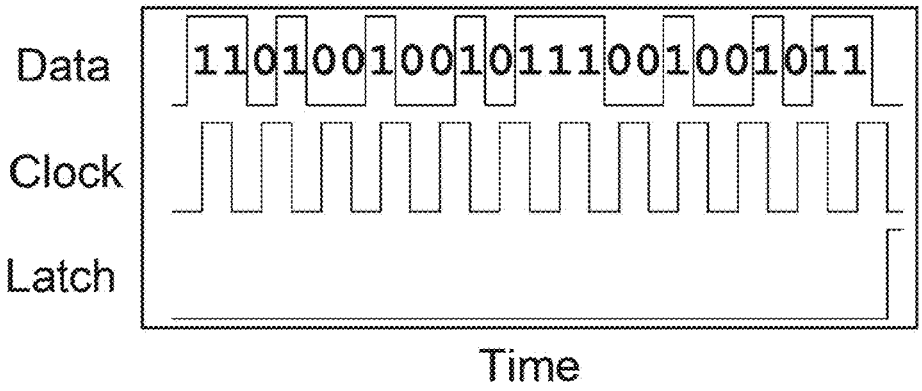
FIG. 14 is a schematic view showing a sample data transfer scheme for the digital frequency information for one m/z point.

Frequency information is passed via a 24-bit divide-by number. This information is generated from the PCI-2517 card (D I/O, B5-B7) and transmitted serially to the frequency divider circuit. Three signals, data, clock, and latch, are used to transmit the information. The clock signal is generated at half the frequency of timer #1. The 24-bit number is redundant, where each bit is repeated in sequence. This allows the 24-bit number to be transmitted at the same frequency of the clock signal (and on the same D I/O port), but 1800 out of phase. The data is clocked into the receiving shift register while the transmitted bit is not changing, minimizing error. This redundancy yields 48 bits of data, which is then padded by 2 bits to allow for latching. Therefore, 50 bits are utilized to transfer frequency information for every m/z data point to be scanned. The data is clocked (on the rising edge) into a series of shift registers, where the latch signal then loads the values, in parallel, onto the frequency generator. A diagram showing the data transfer scheme is shown in FIG. 14, in which there are 50 digital bits scanned out serially on three lines of a D I/O port.

Figure 15:
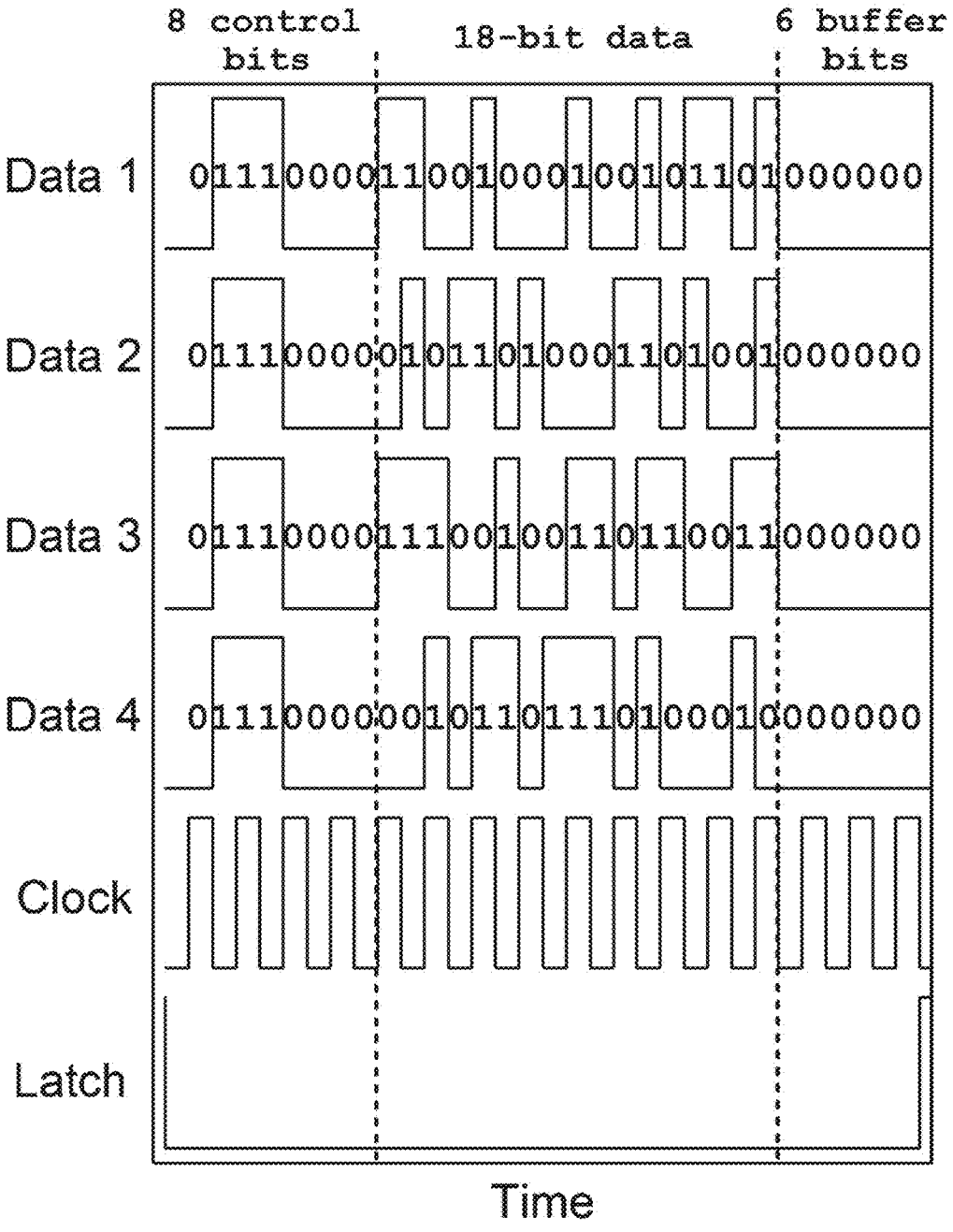
FIG. 15 is a schematic view showing a sample data transfer scheme for waveform voltage information.

The waveform voltage information is transferred to shift registers for four independent DACs. Six signals transfer the data serially. Each DAC receives its own data signal, a clock signal, and a latch signal. The four data signals are independent of one another, while the clock and latch signals are common to all four DACs. Each is a true 18-bit DAC (Linear Technology, LTC2756), allowing sufficient resolution to define many different waveform potentials. For the present configuration, 66 bits are scanned out on each of 6 D I/O lines. Similar to the frequency output, the data is generated redundantly (32 bits of information transferred as 64 bits), and is padded by a buffer bit on either end. The DACs require that the 18 bit data be preceded by 8 control bits, and followed by 6 buffer bits. This requires a total of 32 bits of data to be received by each DAC. The data transfer scheme for this process is described in FIG. 15. Since the DACs utilize more information than the FPGA per m/z point, an extra 16 buffer bits are added to the frequency information so that the two can be scanned simultaneously. This system allows for each DAC to receive data and be updated simultaneously. The six signals are transferred to an external box, where they are converted to fiber optic signals.

Figure 16:
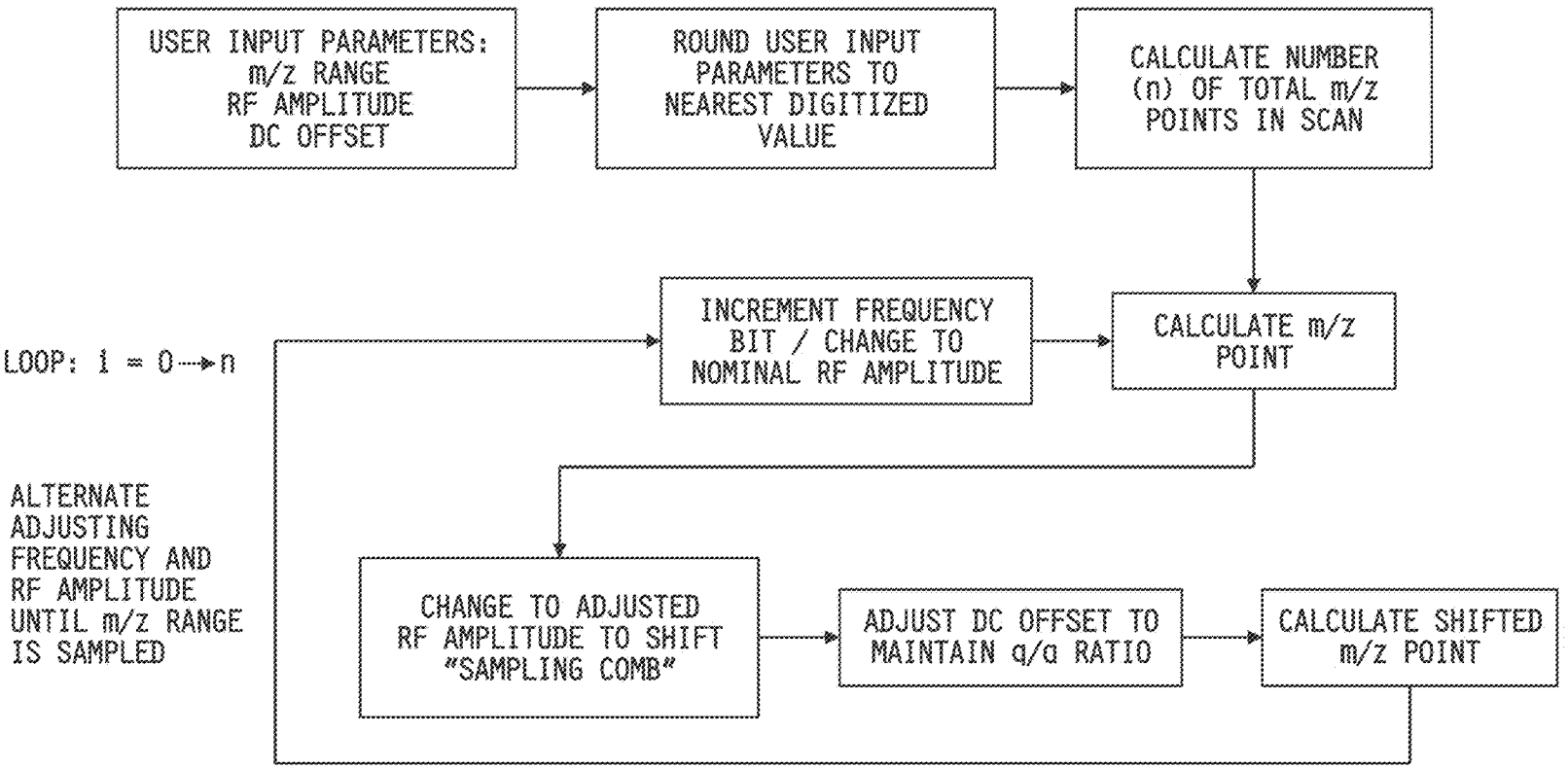
FIG. 16 is a schematic view showing a programmatic flow of the frequency-amplitude scan algorithm.

As described herein, an amplitude scan is overlaid with a frequency scan to double the m/z sampling density. FIG. 16 diagrams the programmatic flow of the computer algorithm that is used to generate the appropriate frequency and RF amplitude values for a defined m/z range. Initially, the routine rounds the user input variables (m/z range, RF amplitude, and DC offset) to the digitized values, determined by the frequency generator and waveform DACs. This rounding process is carried out through each step in the following calculations. The user input RF amplitude and DC offset values are used as nominal values, from which the adjusted values are derived. From the m/z range, the total number of m/z points to be sampled can be calculated, and their respective arrays allocated. Once initialized, the routine enters a loop where the arrays are filled. First, an m/z point is calculated by incrementing the frequency bit from the previous iteration and holding the RF amplitude at the nominal value. The next point is selected by holding the frequency at the same value as the previous point, but incrementing the RF amplitude so that the sampled m/z point is approximately 50% between the m/z points sampled by a change in frequency alone. When the RF amplitude is adjusted, the DC offset may be recalculated and adjusted. This loop is repeated by alternating adjustments in the frequency and RF amplitude until the arrays are filled. At this point, the arrays containing the frequency divide-by bits and waveform voltage bits can be passed back to the main code, where they can be converted into digital waveforms and written out serially by the D I/O.

It will be noted that alternative embodiments of the apparatuses and methods described in the present disclosure may not include all of the features described yet still benefit from at least some of the advantages of such features. Those of ordinary skill in the art may readily devise their own implementations of an apparatus and method that incorporate one or more of the features of the present disclosure and fall within the spirit and scope of the present disclosure.

What is claimed is:

1. A method of operating a quadrupole mass filter, the method comprising ionizing a sample to produce ions, each produced ion having a mass-to-charge ratio, passing the produced ions into a quadrupole, and applying at least one AC voltage to the quadrupole and controlling the at least one AC voltage to separate the ions by (i) incrementally varying a frequency of the at least one AC voltage within a first range of frequencies and (ii) for each of at least some of the incremental frequencies in the first range of frequencies, incrementally varying an amplitude of the at least one AC voltage within a range of amplitudes, wherein each incremental frequency and incremental amplitude pair of the at least one AC voltage creates a different band pass filter in the quadrupole through which produced ions having a different corresponding mass-to-charge ratio pass to a detector.

2. The method of claim 1, further comprising:

detecting with the detector the ions passing through each created band pass filter, and generating a mass-to-charge spectrum based on the detected ions and the corresponding incremental frequency and incremental amplitude pairs of at least some of the created band pass filters.

3. The method of claim 1, wherein (ii) comprises incrementally varying the amplitude of the at least one AC voltage to three or more incremental amplitudes within the range of amplitudes.

4. The method of claim 1, wherein (ii) comprises, for each incremental frequency, incrementally varying the amplitude of the at least one AC voltage to three or more incremental amplitudes within the range of amplitudes.

5. The method of claim 1, further comprising: (iii) incrementally varying the frequency of the at least one AC voltage within a second range of frequencies different from the first range of frequencies, and (ii) for each of at least some of the incremental frequencies in the second range of frequencies, incrementally varying the amplitude of the at least one AC voltage within the range of amplitudes.

6. The method of claim 1, wherein incrementally varying the amplitude of the at least one AC voltage comprises incrementally varying the amplitude to different numbers of amplitudes for different incremental frequencies.

7. The method of claim 1, wherein (ii) comprises controlling the at least one AC voltage to a nominal amplitude at one end of the range of amplitudes, followed by incrementing the amplitude of the at least one AC voltage to a target amplitude within the range of amplitudes that is different from the nominal amplitude, and wherein the target amplitude for each incremental frequency is selected to create a band pass filter through which ions pass having a mass-to-charge ratio midway between a mass-to-charge ratio of ions that passed through the band pass filter created by that incremental frequency and nominal amplitude pair and a mass-to-charge ratio of ions that will pass through the band pass filter that will be created by the next incremental frequency and nominal amplitude pair.

8. The method of claim 7, wherein the target amplitude is different for at least some of the incremental frequencies.

9. The method of claim 1, wherein (ii) comprises controlling the at least one AC voltage to a nominal amplitude at one end of the range of amplitudes, followed by incrementing the amplitude of the at least one AC voltage to two or more target amplitudes within the range of amplitudes that are different from one another and different from the nominal amplitude, and wherein each of the two or more target amplitudes for each incremental frequency is selected to create a band pass filter through which ions pass having mass-to-charge ratio that is a selected fraction between a mass-to-charge ratio of ions that passed through the band pass filter created by that incremental frequency and nominal amplitude or previous target amplitude pair and a mass-to-charge ratio of ions that will pass through the band pass filter that will be created by the that incremental frequency and next target amplitude pair or the next incremental frequency and nominal amplitude pair.

10. The method of claim 9, wherein the two or more target amplitudes increase with incrementally increasing frequencies.

11. The method of claim 1, wherein the AC voltage has a DC offset, and wherein the method further comprises varying the DC offset inversely to the incremental amplitudes of the at least one AC voltage within the range of amplitudes.

12. The method of claim 11, wherein the AC voltage has a DC offset, and wherein a mass-to-charge ratio span of each band pass filter is based on a ratio of the respective incremental amplitude of the at least one AC voltage and the DC offset, and wherein the method further comprises selecting the mass-to-charge ratio span of at least one of the band pass filters by controlling the DC offset relative to the respective incremental amplitude of at the least one AC voltage.

13. The method of claim 1, wherein ionizing the sample comprises ionizing the sample with an electrospray source, and wherein the method further comprises thermalizing the produced ions prior to passing the produced ions into the quadrupole.

14. The method of claim 1 wherein ionizing the sample comprises ionizing the sample with an electrospray source, and wherein the method further comprises passing the produced ions through a drift tube prior to passing the produced ions into the quadrupole.

15. The method of claim 14, further comprising disrupting a directed gas flow from the electrospray source with a jet disrupter disposed in the drift tube.

16. The method of claim 14, further comprising focusing the produced ions exiting the drift tube through an aperture of an ion carpet prior to passing the ions into the quadrupole.

17. The method of claim 16, further comprising thermalizing the ions exiting the ion carpet prior to passing the produced ions into the quadrupole.

18. The method of claim 17, further comprising focusing the thermalized ions toward the quadrupole with a focusing lens.

19. A quadrupole mass filter comprising:

a quadrupole, an ionization source configured to ionize a sample to provide ions to the quadrupole, a detector coupled to the quadrupole for detecting ions passing therethrough, at least one AC voltage source, drive circuitry configured coupled to the quadrupole and to the at least one AC voltage source, and a computer programmed to control the drive circuitry to apply at least one AC voltage produced by the at least one AC voltage source to the quadrupole to separate the ions by (i) incrementally varying a frequency of the at least one AC voltage within a first range of frequencies and (ii) for each of at least some of the incremental frequencies in the first range of frequencies, incrementally varying an amplitude of the at least one AC voltage within a range of amplitudes, such that each incremental frequency and incremental amplitude pair of the at least one AC voltage creates a different band pass filter in the quadrupole through which ions having a different corresponding mass-to-charge ratio pass to the detector.

20. The quadrupole mass filter of claim 19, wherein the computer is programmed to generate a mass-to-charge spectrum based on ions detected by the detector and the corresponding incremental frequency and incremental amplitude pairs of at least some of the created band pass filters.

* * * * *